US012209330B1

(12) United States Patent
Dellinger

(10) Patent No.: US 12,209,330 B1
(45) Date of Patent: Jan. 28, 2025

(54) ELECTROSPINNING APPARATUS AND METHODS

(71) Applicant: AMERICAN NANO LLC., Clemmons, NC (US)

(72) Inventor: Mitch Dellinger, Clemmons, NC (US)

(73) Assignee: American Nano LLC, Clemmons, NC (US)

( * ) Notice: Subject to any disclaimer, the term of this patent is extended or adjusted under 35 U.S.C. 154(b) by 197 days.

(21) Appl. No.: 17/954,474

(22) Filed: Sep. 28, 2022

Related U.S. Application Data

(63) Continuation-in-part of application No. 16/924,307, filed on Jul. 9, 2020, now Pat. No. 11,618,975.

(60) Provisional application No. 62/872,329, filed on Jul. 10, 2019.

(51) Int. Cl.

| | |
|---|---|
| ***D01D 5/06*** | (2006.01) |
| ***D01D 5/00*** | (2006.01) |
| ***D01D 5/18*** | (2006.01) |
| ***D04H 1/728*** | (2012.01) |

(52) U.S. Cl.
CPC ..... *D01D 5/0069* (2013.01); *D01D 5/0046* (2013.01); *D01D 5/18* (2013.01); *D04H 1/728* (2013.01); *D10B 2101/02* (2013.01)

(58) Field of Classification Search
CPC ..... D01D 5/0069; D01D 5/0046; D01D 5/18; D10B 2101/02; D04H 1/728
See application file for complete search history.

(56) References Cited

U.S. PATENT DOCUMENTS

| | | | | |
|---|---|---|---|---|
| 9,428,847 | B2 * | 8/2016 | Scott | D01D 5/003 |
| 9,445,874 | B2 | 9/2016 | Soletti et al. | |
| 9,611,588 | B2 * | 4/2017 | Heiskanen | D01F 6/14 |
| 10,111,783 | B1 | 10/2018 | Dellinger | |
| 10,385,188 | B2 | 8/2019 | Kosaka et al. | |
| 2002/0122840 | A1 * | 9/2002 | Lee | D01D 5/0061 425/174.6 |
| 2005/0233021 | A1 * | 10/2005 | Chun | D01D 5/0092 425/174.8 E |
| 2005/0253305 | A1 * | 11/2005 | Kim | D01D 5/0046 264/465 |
| 2006/0138711 | A1 * | 6/2006 | Bryner | D04H 3/03 264/465 |
| 2007/0269655 | A1 | 11/2007 | Joo et al. | |
| 2008/0290554 | A1 * | 11/2008 | Wu | D01D 5/0069 425/174.8 E |
| 2009/0317446 | A1 | 12/2009 | Tan et al. | |
| 2010/0239861 | A1 * | 9/2010 | Scott | B05D 1/007 524/106 |
| 2011/0274927 | A1 | 11/2011 | Watanabe et al. | |
| 2012/0025429 | A1 * | 2/2012 | Ishikawa | D01D 5/0069 264/412 |
| 2014/0126137 | A1 | 5/2014 | Leonard | |
| 2014/0353882 | A1 * | 12/2014 | Joo | D01D 5/34 425/174.8 R |
| 2015/0257263 | A1 | 9/2015 | Sethumadhavan et al. | |

(Continued)

*Primary Examiner* — Emmanuel S Luk
(74) *Attorney, Agent, or Firm* — Morgan, Lewis & Bockius LLP

(57) ABSTRACT

Embodiments of the invention include electrospinning apparatus and techniques in which a precursor solution is allowed to descend onto a conductive surface, such as the surface of a conductive plate, rather than through needles, and fibers are formed from the precursor solution and deposited on a collector.

26 Claims, 11 Drawing Sheets

(56) References Cited

U.S. PATENT DOCUMENTS

| | | | | |
|---|---|---|---|---|
| 2016/0053090 | A1 | 2/2016 | Kosaka et al. | |
| 2016/0083868 | A1* | 3/2016 | Park | D01D 5/0069 425/174.8 E |
| 2016/0168755 | A1* | 6/2016 | Toyoda | D01D 5/0092 425/72.2 |
| 2016/0201227 | A1 | 7/2016 | Joo et al. | |
| 2017/0218538 | A1* | 8/2017 | Hiramoto | D01D 4/06 |
| 2017/0268129 | A1* | 9/2017 | Uchida | B05B 15/68 |
| 2018/0250718 | A1 | 9/2018 | Sakai | |
| 2018/0346684 | A1 | 12/2018 | Polyzos et al. | |
| 2018/0368968 | A1 | 12/2018 | Leeson et al. | |
| 2019/0270274 | A1 | 9/2019 | Dellinger | |
| 2019/0292685 | A1* | 9/2019 | Fong | B29C 48/142 |
| 2020/0063289 | A1 | 2/2020 | Kuster et al. | |
| 2020/0070519 | A1* | 3/2020 | Tominaga | B32B 5/26 |
| 2020/0099079 | A1 | 3/2020 | Dellinger et al. | |
| 2020/0122169 | A1 | 4/2020 | Sugawara et al. | |
| 2020/0208301 | A1* | 7/2020 | Chun | D01D 5/0069 |
| 2020/0232122 | A1* | 7/2020 | Maksoud | D01D 5/0061 |
| 2020/0240059 | A1* | 7/2020 | Baharlou | D01F 1/10 |
| 2021/0071319 | A1* | 3/2021 | Naka | D01D 5/0069 |
| 2021/0198809 | A1* | 7/2021 | Solberg | D01D 5/0061 |
| 2021/0207291 | A1* | 7/2021 | Agrawal | D04H 1/728 |
| 2022/0096975 | A1* | 3/2022 | Zhang | A62B 23/02 |
| 2022/0106710 | A1* | 4/2022 | Ooshiro | B29C 48/272 |
| 2023/0085519 | A1* | 3/2023 | Morita | C12M 3/00 264/10 |

* cited by examiner

ELECTROSPINNING APPARATUS AND METHODS

RELATED APPLICATIONS

This application is a continuation-in-part of U.S. patent application Ser. No. 16/924,307, filed Jul. 9, 2020, which claims the benefit of and priority to U.S. Provisional Patent Application No. 62/872,329, filed Jul. 10, 2019, the entire disclosure of which is hereby incorporated herein by reference.

TECHNICAL FIELD

In various embodiments, the present invention relates to apparatus and methods for electrospinning of fibers, e.g., silica fibers.

BACKGROUND

Synthetic fibers may be formed from a host of different materials and are utilized in many different applications, including textiles, insulation, and composite materials. While many different types of fiber-production techniques exist, electrospinning is a well-characterized technique that provides various advantages. Electrospinning utilizes electric force to draw charged threads of polymer solutions or polymer melts, thereby forming polymer fibers. Advantageously, electrospinning does not require the use of coagulation chemistry or high temperatures to produce solid threads from solution. This makes the process particularly suited to the production of fibers using large and complex molecules.

While various apparatuses for electrospinning have been utilized, particularly in laboratory settings, these machines are typically not suited for large-scale manufacturing of fibers. Therefore, there is a need for improved and robust apparatus and techniques for electrospinning that enable fiber production at high rates and in large volumes, and which do not require excessive downtime, cleaning procedures, or replacement of various parts of the apparatus.

SUMMARY

In accordance with various embodiments of the present invention, an apparatus for the electrospinning of polymer solutions (e.g., sol-gels) features a system in which the solution is dripped onto one or more charged conductors, from which the fibers are electrospun, rather than fed into one or more hollow conductive needles, as in conventional systems. In various embodiments, the one or more charged conductors may include, consist essentially of, or consist of multiple charged conductive needles or a charged conductive plate. When the solution reaches the one or more charged conductors, it is electrospun into fibers that are collected at a grounded collector (e.g., a plate or drum).

Advantageously, the solution is not fed through the longitudinal axes of hollow needles. The needles, when utilized as the one or more charged conductors, are typically solid, rather than hollow, and therefore do not tend to clog with crystallized portions of the solution. Rather, the conductive plate or conductive needles may simply be wiped or brushed clean after electrospinning to remove any remnant and/or dried solution. Thus, the electrospinning technique is more robust, and less down-time for maintenance (e.g., cleaning, component repair or replacement, etc.) is required when compared to conventional techniques. Apparatuses in accordance with embodiments of the invention therefore enable the large-scale production of fibers and collections thereof (e.g., mats such as non-woven mats) while requiring less downtime than conventional electrospinning machines. Various embodiments of the invention also reduce or minimize exposure of the precursor solution to ambient oxygen until the solution is dripped onto the one or more charged conductors, thereby reducing or substantially eliminating deleterious crystallization of the solution prior to spinning.

In various embodiments, the solution is fed from, for example, a holding tank or other solution source, into a reservoir (or "manifold") of the apparatus. Within the reservoir, the solution may drip directly onto the one or more charged conductors via a series of small holes in the reservoir. In other embodiments, the solution may be contained within a rotatable, air-tight cartridge within the reservoir, and the solution may therefore be supplied to the holes in the reservoir via rotation of the cartridge. In various embodiments, the solution may be supplied to the holding tank, reservoir, or cartridge via a pump, syringe, manual pouring, etc. In various embodiments, the solution is supplied from the holding tank to the reservoir, via one or more tubes, utilizing a peristaltic pump. In such embodiments, the components of the pump are not directly exposed to the solution, as the pump simply forces the solution through the tube via a series of compressions by, e.g., one or more rollers or wipers. Advantageously, non-exposure of the pump and its components to the solution obviates the need for excessive maintenance and cleaning of the pump, increasing up-time and throughput of the electrospinning apparatus.

In various embodiments, the solution is fed from the holding tank to drip directly onto the needles via multiple tubes having openings disposed over the needles. In various embodiments, the tubes are electrically insulating, while the needles are electrically charged. The non-conductive tubes are therefore not electrically charged, and thus the solution will be less likely to react (i.e., as in the electrospinning process), solidify, and partially or completely clog the tubes. In this manner, high throughput of the solution and the electrospinning process may be maintained. Note that the number of solution-supplying tubes need not be equal to the number of electrically charged needles, although these numbers may be equal in various embodiments. Rather, a single tube may drip solution onto multiple different needles (and thus the number of tubes may be less than the number of needles), or multiple tubes may drip solution toward the same needle or set of needles (and thus the number of tubes may be greater than the number of needles).

In various embodiments, the throughput of the apparatus (i.e., the amount of electrospun fiber) may be increased by increasing the number of needles (and, in various embodiments, corresponding holes in the reservoir or corresponding number of tubes) or the size of the conductive plate. Increasing the number and/or configuration of the needles or plate may also alter the shape and size of the assemblage (e.g., mat) of fibers produced on the collector. In various embodiments, the needles or plate and reservoir may be translatable with respect to the collector in order to form larger masses of fibers. For example, the needles or plate and reservoir may be positioned on a motorized stage that translates apparatus during electrospinning.

In various embodiments, the needles may be positioned below the reservoir or the insulating tubes and arranged in multiple rows (or other two-dimensional array). For example, one or more needles in a lower row may be positioned below gaps between two needles in an upper row. That is, the needles may be arranged in two or more "staggered rows." In this manner, any solution that does not drip onto a needle in the upper row may drip onto one or more needles below the upper row (i.e., in one or more rows below the upper row), thereby reducing or substantially eliminating lost or wasted solution. Such arrangements may also advantageously require fewer tubes and thus require less maintenance, replacement, cleaning, etc. associated with the tubes themselves.

In various embodiments of the invention, the solution is fed from the holding tank, via one or more tubes, into a manifold having a series of small holes positioned over a charged conductive plate. The replacement of the series of needles with a plate, unexpectedly, results in similar electrospinning behavior of the solution while simplifying the apparatus and maintenance and cleaning thereof. In these embodiments, the solution drips from the manifold onto the plate, which is typically tilted or angled such the solution flows to the front edge of the plate due to the force of gravity. At the front edge of the plate, Taylor cones form in the solution due to the electric charge, and the solution jets away from the plate to the collector, thereby forming the electrospun fibers. A series of recessed troughs may be formed in the plate, at least at the front edge thereof, in order to facilitate spreading of the solution across the plate, but such recesses are not required for successful electrospinning. After the electrospinning is complete, the plate may simply be wiped clean or replaced, enabling resumption of electrospinning with high throughput and minimal downtime.

In various embodiments, any gelatinous or solid material that forms and/or builds up on the needles or plate of the apparatus may be removed by periodic cleaning. For example, the one or more conductors may be brushed, during and/or after the application of charge thereto (e.g., during an electrospinning process) to remove such extraneous material and facilitate contact of newly dripped solution onto the needles or conductive plate.

In accordance with various embodiments of the invention utilizing needles, the needles are solid, rather than defining one or more hollow lumens therethrough. The needles may be elongated and may taper down to a sharp point at an end thereof. The cross-sectional shape and/or size of one or more of the needles may vary along its length.

The needles or conductive plate may be electrically coupled to a high-voltage source for application of the charge that enables electrospinning. As used herein, a "high-voltage" source is an electrical source capable of producing and maintaining a desired voltage sufficient to enable electrospinning. In various embodiments, high-voltage sources are capable of producing and maintaining voltages ranging from, for example, approximately 1 kV to approximately 100 kV, or approximately 5 kV to approximately 50 kV. High-voltage sources are conventional, commercially available, and may be supplied by those of skill in the art without undue experimentation.

Apparatuses and electrospinning techniques in accordance with embodiments of the present invention may be utilized with many different precursor solutions and sol-gels. For example, in exemplary embodiments, the apparatus may be utilized to form silica fibers from a sol-gel prepared with a silicon alkoxide reagent, such as tetraethyl ortho silicate (TEOS), alcohol solvent, and an acid catalyst. In various embodiments, the sol-gel is produced via ripening of sol under controlled environmental conditions, and/or the properties of the sol or sol-gel during the ripening process are monitored, in order to identify various processing windows during which the electrospinning of the sol-gel may be successfully performed, as disclosed in U.S. patent application Ser. No. 15/934,599, filed on Mar. 23, 2018, U.S. patent application Ser. No. 16/131,531, filed on Sep. 14, 2018, and U.S. patent application Ser. No. 16/353,181, filed on Mar. 14, 2019, the entire disclosure of each of which is incorporated by reference. As known in the art, a "sol" is a colloidal solution that gradually evolves towards the formation of a "gel," i.e., a diphasic system containing both a liquid phase and solid phase. Herein, the term "sol-gel" is used to refer to the gel produced from the sol-gel process that may be electrospun into fibers or a fibrous mat. Herein, the terms "sol" and "solution" are utilized interchangeably unless otherwise indicated.

In various embodiments, the controlled environment for ripening the sol may involve controlled conditions in terms of humidity, temperature, and optionally barometric pressure. For example, the humidity may be controlled within the range of about 30% to about 90%, and the temperature may be controlled within the range of from about 50° F. to about 90° F. By controlling the environmental conditions during ripening, the gel may be electrospun during the time when spinning is optimal, which can occur in a very small window of only several minutes if the ripening process is accelerated by direct heat. When ripening the sol at a constant humidity in the range of about 50% to 80% and a temperature of about 60 to 80° F., the sol will ripen (gelatinize) in a few days, and the window for successful electrospinning may be expanded to at least several hours, and in some embodiments several days. The sol may therefore be ripened in an enclosure which may include one or more environmental monitors, such as a temperature reading device and/or a humidity reading device. Further, gases produced or released by the sol during the ripening process and/or relative weight of the sol may be monitored to determine a suitable or optimal time for electrospinning. In various embodiments, the sol may be ripened within the holding tank, manifold, or cartridge (which may in turn be disposed within the abovementioned enclosure), which may then be coupled into the electrospinning apparatus after the ripening process; in this manner, excessive handling or solution loss is avoided prior to electrospinning. In various embodiments, the solution may be fed from a closed container, e.g., via a pump and one or more tubes, to the manifold for dispersal therefrom onto the charged needles or plate.

Once a sol is adequately ripened into a sol-gel, it may be electrospun to form fibers, for example, in the form of a mat or mass of entangled fibers. Once electrospun, the fibers may have a variable diameter, such as in the range of from about 50 nm to 5 μm. In some embodiments, the fibers are predominately in the range of about 100 nm to about 2 μm, or predominately in the range of about 200 nm to about 1000 nm.

Once electrospun, fibers or mats may be processed into a powder or dust (e.g., a collection of fibrous fragments). For example, electrospun mats or fibers may be "fragmented," i.e., fractured, cut, ground, milled (e.g., in a ball mill or other milling device), pulverized, or otherwise divided into small fragments that maintain a fibrous structure. As used herein, the term "fibrous fragments" (or "fibrous-mat fragments," or simply "fragments") refers to small particles, parts, or flakes of a fibrous mat having an average dimension larger (e.g., 5×, 10×, or even 100×) than the width of at least some of the fibers of the mat. In various embodiments, the average size of a fibrous fragment is in the range of approximately 20 μm to approximately 200 μm. Fibrous fragments may thus resemble microscopic-scale versions of the electrospun mat itself, e.g., intertwined collections of fibers, and thus typically are porous and have low densities. Thus, fibrous fragments may be contrasted with other types of micro-scale particles, such as the substantially spherical particles used in colloidal silica, which are each unitary, individual units or grains, rather than small collections of fibers. Various portions of a fibrous fragment (e.g., the edges) may have sharp and/or broken edges resulting from the fracturing process utilized to form the fragments from the electrospun mat. As utilized herein, the terms "fiber powder," "powder," "dust," and "fiber dust" include collections of particles generated via the fragmentation of electrospun fiber mats and/or fibers, and may include fibrous fragments and/or other powder particles resulting from such fragmentation.

In various embodiments, after electrospinning, fibers and/or fiber mats may be processed into sheets or other desired shapes. For example, the fibers or mats (all or portions of which may be first fragmented into powder), may be pressed or molded into a desired shape for their deployment in a particular device or application. Thus, in various embodiments, products may be or incorporate one or more sheets of fibers. As utilized herein, a "sheet" of fibers refers to an electrospun mat of fibers, with or without additional pressing or processing, or to pressed or molded layers (or other shapes, such as cylinders or tubes) of powder (e.g., fibrous fragments) formed via fragmentation of electrospun fiber mats.

After formation thereof, fibers and fiber mats in accordance with embodiments of the invention may be utilized in a host of different applications. For example, as described in U.S. patent application Ser. No. 16/353,181, filed on Mar. 14, 2019 (the entire disclosure of which is incorporated by reference herein), fibers, fiber mats, and/or fibrous fragments or powder therefrom may be incorporated into solid or liquid compositions in order to impart superior properties (e.g., thermal properties, mechanical properties, etc.) thereto; resulting products may include, for example, particle board, paints and other coatings, thermal shielding, textiles, fire-resistant panels and clothing, body armor, etc. As described in U.S. patent application Ser. No. 16/367,313, filed on Mar. 28, 2019 (the entire disclosure of which is incorporated by reference herein), fibers or powder or fragments therefrom may be incorporated into topical compositions (e.g., mixed with one or more topical carriers) and applied to improve skin healing, to prevent or reduce scarring, reduce signs of aging, and/or to reduce pain and/or irritation associated with damaged or diseased skin. As described in U.S. patent application Ser. No. 16/422,100, filed on May 24, 2019 (the entire disclosure of which is incorporated by reference herein), fibers, fiber mats, or powder or fragments therefrom may be incorporated into various components of a battery or other charge-storage device. As described in U.S. patent application Ser. No. 16/578,915, filed on Sep. 23, 2019 (the entire disclosure of which is incorporated by reference herein), fibers, fiber mats, or powder or fragments therefrom may be utilized as or in the structural matrix for one or more components of a fuel cell. As described in U.S. patent application Ser. No. 16/660,936, filed on Oct. 23, 2019 (the entire disclosure of which is incorporated by reference herein), fibers, fiber mats, or powder or fragments therefrom may be utilized as and/or within artificial nerve conduits. As described in U.S. patent application Ser. No. 17/011,060, filed on Sep. 3, 2020, and U.S. patent application Ser. No. 17/685,617, filed on Mar. 3, 2022 (the entire disclosure of each of which is incorporated by reference herein), fibers, fiber mats, or powder or fragments therefrom may be utilized in or as hemostatic materials or devices to treat hemorrhage (bleeding) in a subject. As described in U.S. patent application Ser. No. 16/924,308, filed on Jul. 9, 2020 (the entire disclosure of which is incorporated by reference herein), fibers, fiber mats, or powder or fragments therefrom may be utilized as part of the structural matrix, and/or as a filler and/or wipe material, for firearm sound suppressors and/or within or as an insulating sleeve disposed around a sound suppressor, and/or around a portion of a firearm itself (e.g., all or a portion of the barrel).

For use of the fibers, fiber mats, sheets, or powders or fragments therefrom in various different applications, one or more different additives or other materials (e.g., conductive agents such as metals or carbon, healing agents, etc.) may be applied to the fibers (or fragments or dust thereof) before, during, and/or after the electrospinning process. For example, an additive may be applied to the electrospun or electrospinning fibers, and/or into the solution prior to electrospinning (e.g., before, during, or after ripening of the solution). That is, an additive may be mixed within the solution, which is then electrospun, and/or an additive may be dripped onto the electrically charged conductor(s) of the electrospinning apparatus and thereby be incorporated into the fibers themselves as they are electrospun.

In various embodiments, one or more additives may be incorporated into (e.g., mixed with) powder formed via fragmentation of the electrospun fibers. Such powders may be utilized within, on, and/or as a portion of various devices like those described above, and the powders may be pressed or molded into the proper shape for their deployment within or as a portion thereof. As utilized herein, in a fiber composition "incorporating" another material in or on the structure, the material may be bonded to or otherwise adhered to in a substantially solid form, present within the crystalline structure of the fibers or powder particles themselves, and/or present within a mat or sheet (e.g., within pores or spaces between fibers) or within a collection of powder particles as a solid or in liquid form (e.g., in solution with one or more liquid binders or carriers).

In an aspect, embodiments of the invention feature an electrospinning apparatus that includes, consists essentially of, or consists of a reservoir, a plurality of needles, a high-voltage source, and a collector. The collector may be electrically grounded. The reservoir has an interior volume for receiving a precursor solution and defines a plurality of openings for egress of the precursor solution from the reservoir. The needles are positioned below and spaced apart from the plurality of openings. The high-voltage source is electrically coupled to the plurality of needles. The collector is spaced apart from the needles. Exposed tips of the needles are oriented toward the collector.

Embodiments of the invention may include one or more of the following in any of a variety of combinations. The apparatus may include an inlet fluidly coupled to the interior volume of the reservoir. The apparatus may include a holding tank, fluidly coupled or couplable to the inlet, for containing the precursor solution. The apparatus may include one or more valves for controlling flow of the precursor solution from the holding tank into the reservoir via the inlet. The openings may be disposed on a bottom surface of the reservoir. The collector may include, consist essentially of, or consist of a planar surface and/or a rotatable drum. The apparatus may include a blower positioned to blow air and/or another gas toward the collector. The apparatus may include a blower or sprayer configured to dispense one or more fluids (e.g., liquids, gases, slurries, etc.) toward the collector and/or toward an area between the needles and the collector. The apparatus may include a platform on which the reservoir and the plurality of needles are mounted. The platform may be translatable in a direction substantially perpendicular to a direction in which the needles extend. The apparatus may include a cartridge configured to be received within the reservoir. The cartridge may define therewithin a hollow slot for receiving precursor solution. The cartridge may be rotatable between (i) a first configuration in which the slot is not fluidly coupled to the openings in the reservoir, and (ii) a second configuration in which the slot is fluidly coupled to the openings in the reservoir. The reservoir may include an inlet fluidly coupled to the interior volume of the reservoir, and in the first configuration, the slot may be fluidly coupled to the inlet. The high-voltage source may be configured to supply a voltage ranging from approximately 5 kV to approximately 50 kV.

In another aspect, embodiments of the invention feature a method of electrospinning fibers. A precursor solution is supplied into an interior volume of a reservoir. The reservoir defines a plurality of openings positioned above and spaced apart from a plurality of needles. Tips of the needles are oriented toward a collector. Electrical charge (e.g., a voltage) is applied to the needles, or a voltage difference is applied between the needles and the collector. The precursor solution is allowed to descend onto the needles via the openings in the reservoir, whereby fibers are formed from the precursor solution proximate the needles and deposited on the collector.

Embodiments of the invention may include one or more of the following in any of a variety of combinations. The collector may be rotated and/or translated during formation of the fibers. Air and/or another gas may be blown toward the collector during and/or after formation of the fibers. The precursor solution may be supplied into the interior volume of the reservoir via a cartridge insertable into the reservoir. The precursor solution may be disposed within a hollow slot defined in the cartridge. Allowing the precursor solution to descend onto the needles may include, consist essentially of, or consist of rotating the cartridge within the reservoir to fluidly couple the slot with the openings in the reservoir. One or more additives may be disposed or dispensed into the precursor solution before allowing the precursor solution to descend onto the needles, whereby the one or more additives are incorporated into the fibers. One or more additives may be disposed or dispensed onto the fibers after formation of the fibers and before the fibers are deposited on the collector, whereby the one or more additives are incorporated into the fibers. One or more additives may be disposed or dispensed onto the fibers after the fibers are deposited on the collector, whereby the one or more additives are incorporated into the fibers. After the fibers are deposited on the collector, at least a portion of the fibers may be pressed or molded into a desired shape (e.g., a planar sheet, a hollow tube, etc.) After the fibers are deposited on the collector, at least a portion of the fibers may be processed into a powder or dust. The powder or dust may include, consist essentially of, or consist of a plurality of fibrous fragments. The fibrous fragments may be composed of a plurality of silica fibers or portions thereof. The fibrous fragments may have an average size between approximately 20 μm and approximately 200 μm. The fibers or portions thereof within the fibrous fragments may have diameters ranging from approximately 50 nm to approximately 5 μm. The fibers or portions thereof within the fibrous fragments may have diameters ranging from approximately 200 nm to approximately 1000 nm.

The precursor solution may include, consist essentially, or consist of a sol-gel. The fibers may include, consist essentially of, or consist of silica. The sol-gel may be prepared with tetraethylorthosilicate (TEOS). The sol-gel may be produced from an initial sol containing 75% to 90% TEOS, 8% to 25% ethanol, an acid catalyst, and the balance water. The initial sol may include, consist essentially of, or consist of 70% to 90% TEOS by weight, 8% to 25% ethanol by weight, an acid catalyst, and water. The initial sol may contain 70% to 90% TEOS by weight, 8% to 25% ethanol by weight, an acid catalyst, and the balance water. The initial sol may include, consist essentially of, or consist of 70% to 90% TEOS by weight, 8% to 25% ethanol by weight, an acid catalyst, and water. The initial sol may contain 70% to 90% TEOS by weight, 8% to 25% ethanol by weight, an acid catalyst, and the balance water. The initial sol may include, consist essentially of, or consist of 70% to 90% TEOS by weight, 8% to 25% ethanol by weight, an acid catalyst, and water. The initial sol may include, consist essentially of, or consist of 70% to 90% TEOS by weight, 8% to 25% ethanol by weight, 1% to 10% water by weight, and the acid catalyst. The initial sol may include, consist essentially of, or consist of 75% to 85% by weight TEOS, 12% to 20% by weight ethanol, and about 2% to 5% by weight water. The initial sol may include, consist essentially of, or consist of about 80% by weight TEOS, about 17% by weight ethanol, and about 3% by weight water. The acid catalyst may include, consist essentially of, or consist of HCl. The initial sol may contain less than about 0.1% of the acid catalyst by weight. The initial sol may contain from 0.02% to 0.08% of the acid catalyst by weight. The initial sol may contain one or more reagents and/or additives that alter one or more properties of the initial sol, the sol-gel, and/or the silica fibers.

Producing the sol-gel may include transitioning (or ripening) the initial sol for at least 2 days under conditions where humidity is within the range of about 40% to about 80%, and the temperature is within the range of 50° F. to 90° F. The initial sol may be allowed to transition for at least 3 days, at least 4 days, at least 5 days, at least 6 days, or at least 7 days. The initial sol may be allowed to transition for 2 days to 10 days, and for 2 days to 7 days in some embodiments. The sol-gel may be electrospun when the weight is at from 10% to 60% of the starting weight of the initial sol or sol-gel before ripening (transitioning). The sol-gel may be electrospun when the weight is at from 10% to 40% of the starting weight of the initial sol or sol-gel before ripening (transitioning). The sol-gel may be electrospun when the weight is at from 20% to 40% of the starting weight of the initial sol or sol-gel before ripening (transitioning). The sol-gel may be electrospun when the production of ethylene vapor is 10% to 20% relative to the peak production of ethylene vapors during ripening (transitioning) of the initial sol or sol-gel before ripening. The sol-gel may be electrospun when the production of ethylene vapor therefrom is 10% to 40% relative to the initial sol or sol-gel before ripening (transitioning).

In yet another aspect, embodiments of the invention feature an electrospinning apparatus that includes, consists essentially of, or consists of a plurality of hollow tubes, a plurality of needles positioned below and spaced apart from the plurality of tubes, a high-voltage source electrically coupled to the plurality of needles, and a collector spaced apart from the needles. The collector may be electrically grounded. The tubes may be electrically insulating. The tubes are configured to receive a precursor solution at first ends thereof. The needles are positioned to receive thereon precursor solution from second ends of the tubes. Exposed tips of the needles are oriented toward the collector.

Embodiments of the invention may include one or more of the following in any of a variety of combinations. The apparatus may include a holding tank for containing the precursor solution. The holding tank may be fluidly coupled or couplable to the first ends of the tubes. The apparatus may include one or more valves for controlling flow of the precursor solution from the holding tank into the tubes. The needles may be mounted on a support platform. The support platform may define a plurality of openings through which the second ends of the tubes extend (i.e., partially or completely therethrough; the second ends of the tubes may protrude from the openings). The collector may include, consist essentially of, or consist of a planar surface and/or a rotatable drum. The apparatus may include a blower positioned to blow air and/or another gas toward the collector. The apparatus may include a blower or sprayer configured to dispense one or more fluids (e.g., liquids, gases, slurries, etc.) toward the collector and/or toward an area between the needles and the collector. The apparatus may include a platform on which the plurality of needles are mounted and through or on which the second ends of the tubes are disposed. The platform may be translatable in a direction substantially perpendicular to a direction in which the needles extend. The high-voltage source may be configured to supply a voltage ranging from approximately 5 kV to approximately 50 kV. The needles may be arranged in a plurality of staggered rows. The apparatus may include (i) a support defining a plurality of openings therethrough for receiving the second ends of the tubes and (ii) mounted on the support below the plurality of openings, a platform on which the needles are mounted. The platform may be electrically conductive.

In another aspect, embodiments of the invention feature a method of electrospinning fibers. A precursor solution is supplied into first ends of a plurality of hollow tubes, the tubes having second ends positioned above and spaced apart from a plurality of needles. The tubes may be electrically insulating. Tips of the needles are oriented toward a collector. A voltage is applied to the needles, or a voltage difference is applied between the needles and the collector. The precursor solution is allowed to descend onto the needles via the second ends of the tubes, whereby fibers are formed from the precursor solution proximate the needles and deposited on the collector.

Embodiments of the invention may include one or more of the following in any of a variety of combinations. The collector may be rotated and/or translated during formation of the fibers. Air and/or another gas may be blown toward the collector during and/or after formation of the fibers. The precursor solution may be supplied into the hollow tubes from a holding tank. Material (e.g., precursor material or dried or partially spun precursor material) may be removed from the needles during and/or after fiber formation. One or more additives may be disposed or dispensed into the precursor solution before allowing the precursor solution to descend onto the needles, whereby the one or more additives are incorporated into the fibers. One or more additives may be disposed or dispensed onto the fibers after formation of the fibers and before the fibers are deposited on the collector, whereby the one or more additives are incorporated into the fibers. One or more additives may be disposed or dispensed onto the fibers after the fibers are deposited on the collector, whereby the one or more additives are incorporated into the fibers. After the fibers are deposited on the collector, at least a portion of the fibers may be pressed or molded into a desired shape (e.g., a planar sheet, a hollow tube, etc.) After the fibers are deposited on the collector, at least a portion of the fibers may be processed into a powder or dust. The powder or dust may include, consist essentially of, or consist of a plurality of fibrous fragments. The fibrous fragments may be composed of a plurality of silica fibers or portions thereof. The fibrous fragments may have an average size between approximately 20 μm and approximately 200 μm. The fibers or portions thereof within the fibrous fragments may have diameters ranging from approximately 50 nm to approximately 5 μm. The fibers or portions thereof within the fibrous fragments may have diameters ranging from approximately 200 nm to approximately 1000 nm.

The precursor solution may include, consist essentially, or consist of a sol-gel. The fibers may include, consist essentially of, or consist of silica. The sol-gel may be prepared with tetraethylorthosilicate (TEOS). The sol-gel may be produced from an initial sol containing 75% to 90% TEOS, 8% to 25% ethanol, an acid catalyst, and the balance water. The initial sol may include, consist essentially of, or consist of 70% to 90% TEOS by weight, 8% to 25% ethanol by weight, an acid catalyst, and water. The initial sol may contain 70% to 90% TEOS by weight, 8% to 25% ethanol by weight, an acid catalyst, and the balance water. The initial sol may include, consist essentially of, or consist of 70% to 90% TEOS by weight, 8% to 25% ethanol by weight, an acid catalyst, and water. The initial sol may contain 70% to 90% TEOS by weight, 8% to 25% ethanol by weight, an acid catalyst, and the balance water. The initial sol may include, consist essentially of, or consist of 70% to 90% TEOS by weight, 8% to 25% ethanol by weight, an acid catalyst, and water. The initial sol may include, consist essentially of, or consist of 70% to 90% TEOS by weight, 8% to 25% ethanol by weight, 1% to 10% water by weight, and the acid catalyst. The initial sol may include, consist essentially of, or consist of 75% to 85% by weight TEOS, 12% to 20% by weight ethanol, and about 2% to 5% by weight water. The initial sol may include, consist essentially of, or consist of about 80% by weight TEOS, about 17% by weight ethanol, and about 3% by weight water. The acid catalyst may include, consist essentially of, or consist of HCl. The initial sol may contain less than about 0.1% of the acid catalyst by weight. The initial sol may contain from 0.02% to 0.08% of the acid catalyst by weight. The initial sol may contain one or more reagents and/or additives that alter one or more properties of the initial sol, the sol-gel, and/or the silica fibers.

Producing the sol-gel may include transitioning (or ripening) the initial sol for at least 2 days under conditions where humidity is within the range of about 40% to about 80%, and the temperature is within the range of 50° F. to 90° F. The initial sol may be allowed to transition for at least 3 days, at least 4 days, at least 5 days, at least 6 days, or at least 7 days. The initial sol may be allowed to transition for 2 days to 10 days, and for 2 days to 7 days in some embodiments. The sol-gel may be electrospun when the weight is at from 10% to 60% of the starting weight of the initial sol or sol-gel before ripening (transitioning). The sol-gel may be electrospun when the weight is at from 10% to 40% of the starting weight of the initial sol or sol-gel before ripening (transitioning). The sol-gel may be electrospun when the weight is at from 20% to 40% of the starting weight of the initial sol or sol-gel before ripening (transitioning). The sol-gel may be electrospun when the production of ethylene vapor is 10% to 20% relative to the peak production of ethylene vapors during ripening (transitioning) of the initial sol or sol-gel before ripening. The sol-gel may be electrospun when the production of ethylene vapor therefrom is 10% to 40% relative to the initial sol or sol-gel before ripening (transitioning).

In an aspect, embodiments of the invention feature an electrospinning apparatus that includes, consists essentially of, or consists of an electrically insulating manifold, one or more electrically insulating tubes, a conductive plate, a high-voltage source, and a collector. The collector may be electrically grounded. The manifold has one or more inlets and an interior volume for receiving a precursor solution, and defines a plurality of outlet holes for egress of the precursor solution from the manifold. The one or more tubes supply the precursor solution to the manifold via the one or more inlets, and each tube has a first end fluidly coupled to one of the inlets. The conductive plate is spaced apart from the plurality of outlet holes and the manifold and is positioned to receive the precursor solution from the outlet holes. The high-voltage source is electrically coupled to the conductive plate. The collector is spaced apart from the front edge of the conductive plate. The collector is positioned to receive electrospun precursor solution, in fibrous form, from the front edge of the conductive plate.

Embodiments of the invention may include one or more of the following in any of a variety of combinations. The apparatus may include a holding tank, fluidly coupled or couplable to a second end of at least one of the rubes, for containing the precursor solution. The apparatus may include a pump for controlling flow of the precursor solution from the holding tank into the manifold. The pump may include, consist essentially of, or consist of a peristaltic pump. At least the front edge of the conductive plate may define therein a plurality of recesses. The conductive plate (or at least its top surface) may be angled downward with the front edge of the conductive plate disposed below a back edge of the conductive plate.

The collector may include, consist essentially of, or consist of a planar surface and/or a rotatable drum. The apparatus may include a blower positioned to blow air and/or another gas toward the collector. The apparatus may include a blower or sprayer configured to dispense one or more fluids (e.g., liquids, gases, slurries, etc.) toward the collector and/or toward an area between the conductive plate and the collector. The high-voltage source may be configured to supply a voltage ranging from approximately 5 kV to approximately 50 kV.

In another aspect, embodiments of the invention feature a method of electrospinning fibers. A precursor solution is supplied into an electrically insulating manifold. The manifold defines a plurality of outlet holes disposed above and spaced apart from a conductive plate. Electrical charge (e.g., a voltage) is applied to the plate, or a voltage difference is applied between the plate and the collector. The precursor solution is allowed to exit the outlet holes onto the conductive plate, whereby fibers are formed from the precursor solution proximate a front edge of the conductive plate and deposited on a collector spaced apart from the conductive plate.

Embodiments of the invention may include one or more of the following in any of a variety of combinations. Supplying the precursor solution may include, consist essentially of, or consist of urging or pumping the precursor solution from a holding tank to the manifold through one or more tubes. The precursor solution may be pumped via a peristaltic pump. The collector may be rotated and/or translated during formation of the fibers. Air and/or another gas may be blown toward the collector during and/or after formation of the fibers. Material may be removed from the conductive plate during and/or after fiber formation.

One or more additives may be disposed or dispensed into the precursor solution before allowing the precursor solution to exit onto the conductive plate, whereby the one or more additives are incorporated into the fibers. One or more additives may be disposed or dispensed onto the fibers after formation of the fibers and before the fibers are deposited on the collector, whereby the one or more additives are incorporated into the fibers. One or more additives may be disposed or dispensed onto the fibers after the fibers are deposited on the collector, whereby the one or more additives are incorporated into the fibers. After the fibers are deposited on the collector, at least a portion of the fibers may be pressed or molded into a desired shape (e.g., a planar sheet, a hollow tube, etc.) After the fibers are deposited on the collector, at least a portion of the fibers may be processed into a powder or dust. The powder or dust may include, consist essentially of, or consist of a plurality of fibrous fragments. The fibrous fragments may be composed of a plurality of silica fibers or portions thereof. The fibrous fragments may have an average size between approximately 20 μm and approximately 200 μm. The fibers or portions thereof within the fibrous fragments may have diameters ranging from approximately 50 nm to approximately 5 μm. The fibers or portions thereof within the fibrous fragments may have diameters ranging from approximately 200 nm to approximately 1000 nm.

The precursor solution may include, consist essentially, or consist of a sol-gel. The fibers may include, consist essentially of, or consist of silica. The sol-gel may be prepared with tetraethylorthosilicate (TEOS). The sol-gel may be produced from an initial sol containing 75% to 90% TEOS, 8% to 25% ethanol, an acid catalyst, and the balance water. The initial sol may include, consist essentially of, or consist of 70% to 90% TEOS by weight, 8% to 25% ethanol by weight, an acid catalyst, and water. The initial sol may contain 70% to 90% TEOS by weight, 8% to 25% ethanol by weight, an acid catalyst, and the balance water. The initial sol may include, consist essentially of, or consist of 70% to 90% TEOS by weight, 8% to 25% ethanol by weight, an acid catalyst, and water. The initial sol may contain 70% to 90% TEOS by weight, 8% to 25% ethanol by weight, an acid catalyst, and the balance water. The initial sol may include, consist essentially of, or consist of 70% to 90% TEOS by weight, 8% to 25% ethanol by weight, an acid catalyst, and water. The initial sol may include, consist essentially of, or consist of 70% to 90% TEOS by weight, 8% to 25% ethanol by weight, 1% to 10% water by weight, and the acid catalyst. The initial sol may include, consist essentially of, or consist of 75% to 85% by weight TEOS, 12% to 20% by weight ethanol, and about 2% to 5% by weight water. The initial sol may include, consist essentially of, or consist of about 80% by weight TEOS, about 17% by weight ethanol, and about 3% by weight water. The acid catalyst may include, consist essentially of, or consist of HCl. The initial sol may contain less than about 0.1% of the acid catalyst by weight. The initial sol may contain from 0.02% to 0.08% of the acid catalyst by weight. The initial sol may contain one or more reagents and/or additives that alter one or more properties of the initial sol, the sol-gel, and/or the silica fibers.

Producing the sol-gel may include transitioning (or ripening) the initial sol for at least 2 days under conditions where humidity is within the range of about 40% to about 80%, and the temperature is within the range of 50° F. to 90° F. The initial sol may be allowed to transition for at least 3 days, at least 4 days, at least 5 days, at least 6 days, or at least 7 days. The initial sol may be allowed to transition for 2 days to 10 days, and for 2 days to 7 days in some embodiments. The sol-gel may be electrospun when the weight is at from 10% to 60% of the starting weight of the initial sol or sol-gel before ripening (transitioning). The sol-gel may be electrospun when the weight is at from 10% to 40% of the starting weight of the initial sol or sol-gel before ripening (transitioning). The sol-gel may be electrospun when the weight is at from 20% to 40% of the starting weight of the initial sol or sol-gel before ripening (transitioning). The sol-gel may be electrospun when the production of ethylene vapor is 10% to 20% relative to the peak production of ethylene vapors during ripening (transitioning) of the initial sol or sol-gel before ripening. The sol-gel may be electrospun when the production of ethylene vapor therefrom is 10% to 40% relative to the initial sol or sol-gel before ripening (transitioning).

These and other objects, along with advantages and features of the present invention herein disclosed, will become more apparent through reference to the following description, the accompanying drawings, and the claims. Furthermore, it is to be understood that the features of the various embodiments described herein are not mutually exclusive and may exist in various combinations and permutations. As used herein, the terms "approximately," "about," and "substantially" mean ±10%, and in some embodiments, ±5%. The term "consists essentially of" means excluding other materials that contribute to function, unless otherwise defined herein. Nonetheless, such other materials may be present, collectively or individually, in trace amounts. Unless otherwise indicated, nerve conduits, materials, mixtures, regions, and other structures described herein may incorporate unintentional impurities.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

In various embodiments of the present invention, fibers are produced by electrospinning utilizing an apparatus that supplies a precursor solution (e.g., a sol-gel) to one or more charged conductors (e.g., one or more plates, or needles such as conductive pins or other elongated conductive structures) above the conductor(s) rather than, for example, through charged needles themselves (e.g., through lumens in hollow spinnerets). The resulting fiber is spun onto the surface of a collector, where it may be harvested for use in any of a host of different applications. In exemplary embodiments, the apparatus is utilized to produce electrospun silica fibers, but the material of the fibers and of the precursor solution does not limit the scope of embodiments of the present invention.

Figure 1:
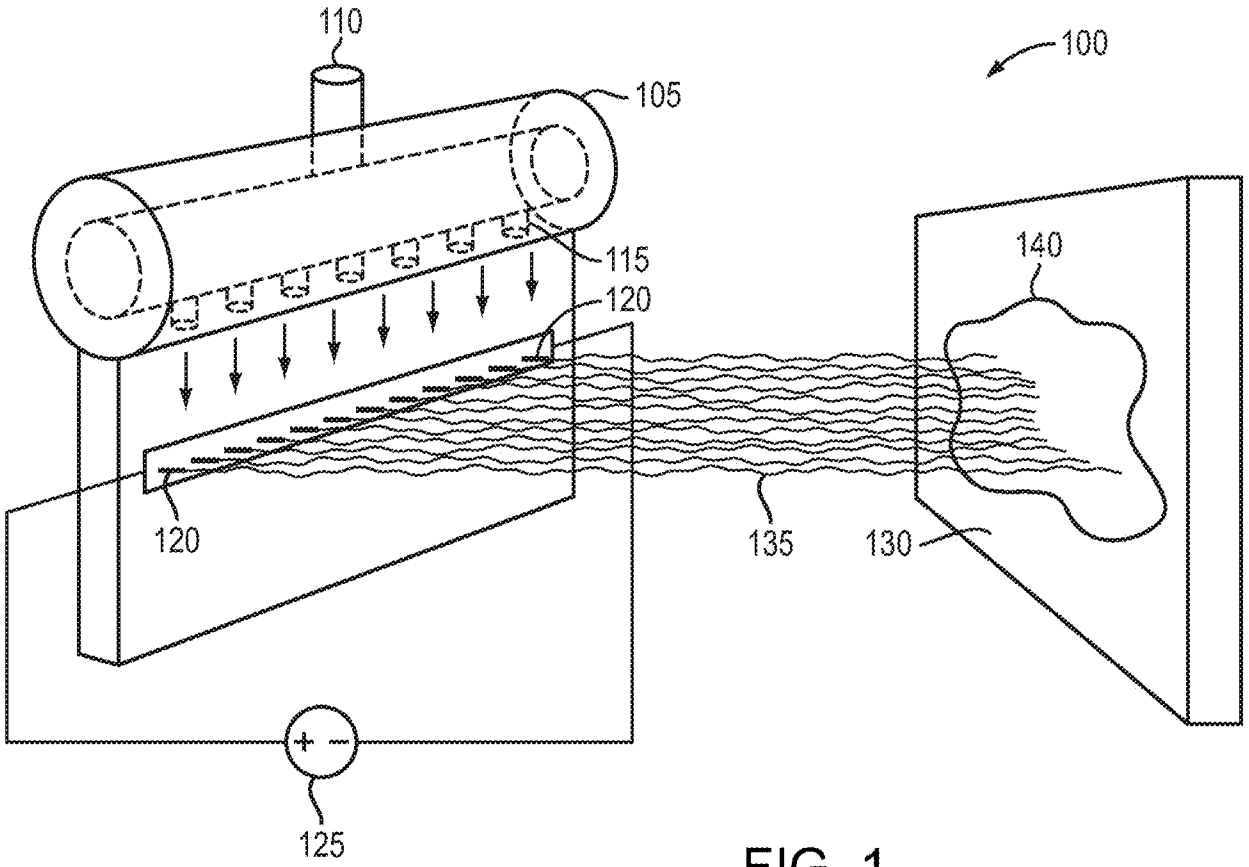
FIG. 1 is a schematic diagram of an electrospinning apparatus in accordance with embodiments of the present invention.

FIG. 1 is a schematic diagram of an electrospinning apparatus 100 in accordance with embodiments of the present invention. As shown, the apparatus 100 features a hollow reservoir 105 into which a precursor solution (e.g., a sol-gel) is disposed for electrospinning of fibers. The reservoir 105 may be equipped with an inlet 110 for supplying the precursor solution, and the reservoir 105 also features a series of openings 115 in its bottom surface that are fluidly coupled to the interior volume of reservoir 105. After the precursor solution is supplied into the interior volume of the reservoir 105, it drips or slowly flows through the openings 115 onto a series of needles 120. In various embodiments, the precursor solution drips through the openings 115 via the force of gravity and without additional fluid pressure exerted via the inlet 110. In various embodiments, the precursor solution is sufficiently viscous (and thus flows from the openings 115 sufficiently slowly) such that the reservoir 105 is easily completely or partially filled with the precursor solution before the solution flows from the openings 115.

The needles 120 are electrically coupled to a high-voltage source 125, which may supply a voltage of, for example approximately 5 kV to approximately 50 kV. The needles 120 point toward a collector 130. In various embodiments, the collector 130 is maintained at a voltage different from (e.g., less than) that of the needles 120; for example, the collector 130 may be electrically grounded. In various embodiments, the collector 130 may be a wall or other surface, and in other embodiments, the collector 130 may be a rotatable drum. (For example, the drum may rotate during fiber spinning along an axis of rotation approximately perpendicular to the spinning direction extending from the needles 120 to the collector 130. See, e.g., FIG. 3C.)

In various embodiments, as the precursor solution drips onto the needles 120, the high voltage between the needles 120 and the collector 130 forms charged fluid jets at the needles 120 that solidify into fibers 135. Thus, in embodiments of the present invention, the precursor solution drips (e.g., at least partially through free space) toward and/or onto the needles 120, rather than being supplied to tips of the needles 120 through the needles 120 themselves (e.g., via hollow lumens within the needles). The fibers 135 deposit onto the collector 130, for example as a fiber mat (e.g., a non-woven mat) 140. The fibers may be harvested from the collector 130 for use in a host of different applications.

In the embodiment depicted in FIG. 1, the needles 120 and collector 130 are configured such that the fibers 135 are electrospun substantially horizontally toward the collector 130. In other embodiments, the electrospinning direction may be different and may be at least partially dependent upon the angle at which the needles 120 are directed and/or upon the directionality of the electric field between the needles 120 and the collector 130. For example, the needles may be pointed downward, below the horizontal plane (and, in various embodiments, above the fully vertical plane), and the collector 130 may be disposed below the needles 120. In various embodiments, one or more of the needles may be angled at a direction different from that at which one or more of the other needles are angled. In this manner, the electrospinning fibers may be collected over a larger area if desired. In other embodiments, all of the needles are angled at approximately the same angle. In various embodiments, the needles 120 may even be directed substantially vertically downward, and the fibers 135 may therefore be spun substantially vertically from the needles 120. In such embodiments, the solution may be dripped or dispensed from above the needles onto, for example, a perforated platform disposed above and holding the charged needles 120; the solution may fall through openings in the platform and onto the needles, whereupon it is electrospun into fibers 135.

The material of the reservoir 105 is not particularly limited, although in various embodiments the reservoir 105 includes, consists essentially of, or consists of one or more materials that are unreactive to the particular precursor solution utilized to form electrospun fibers. In various embodiments, the reservoir 105 may include, consist essentially of, or consist of a polymeric or plastic material such as a fluoropolymer, e.g., polytetrafluoroethylene (PTFE). In various embodiments, the reservoir 105 is electrically insulating, such that electrical charge does not prematurely begin the electrospinning process while the solution is contained within the reservoir 105. The needles 120 may include, consist essentially of, or consist of one or more conductive materials, for example, a metal such as stainless steel, aluminum, and/or copper.

In various embodiments, the reservoir 105 and needles 120 may be disposed on a movable platform that is movable parallel to the collector 130. In this manner, the length along the collector 130 of the resulting fiber assemblage may be increased without increasing the number of needles 120. In various embodiments, the collector 130 may itself be movable (e.g., translatable and/or rotatable) in order to increase the areal size of the assemblage (e.g., mat) of electrospun fibers. The thickness of the electrospun mat may be largely dependent upon the amount of precursor solution utilized for spinning and thus the amount of electrospinning time. For example, the mat may have a thickness of greater than about ⅛ inch, or greater than about ¼ inch, or greater than about ⅓ inch, or greater than about ½ inch.

In various embodiments of the invention, the inlet 110 is fluidly connected to a holding tank containing a larger volume of the precursor solution, and the introduction of the precursor solution into the inlet 110 is controlled by one or more valves. In other embodiments, the precursor solution may be introduced directly into the inlet 110 via, e.g., pumping from a pump or syringe, or pouring from a container.

In various embodiments, after electrospinning of fibers 135, the reservoir 105 and openings 115 may be cleaned by, for example, introducing water and/or a cleaning solution into the reservoir 105 via inlet 110. The fluid may be pressurized to force the fluid through the openings 115 to ensure removal of any remnant precursor solution. Such cleaning cycles may prevent crystallization or solidification of the precursor solution that might clog or block the openings 115.

Figure 2A:
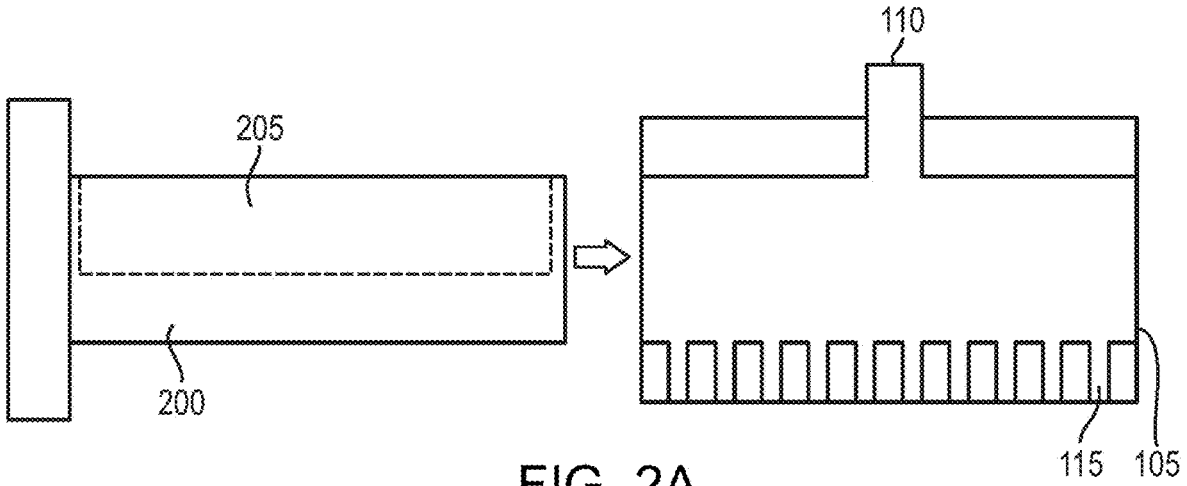
FIGS. 2A-2C are schematic diagrams of portions of an electrospinning apparatus in accordance with embodiments of the present invention.
Figure 2B:
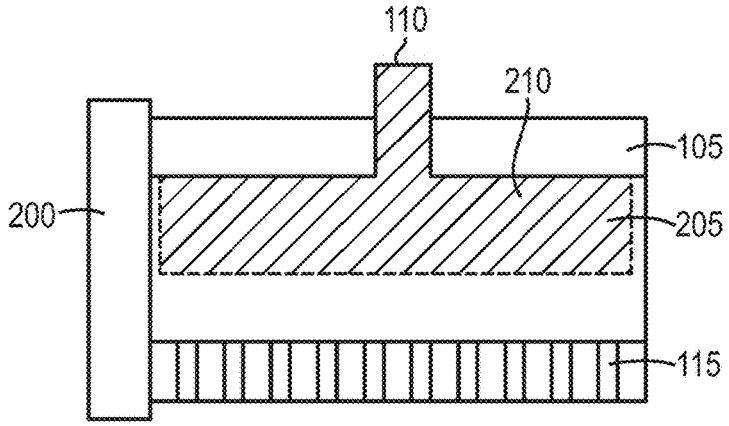

Embodiments of the invention may include a cartridge-based system for controlled introduction of the precursor solution to the openings 115 (and thence to the needles 120). FIG. 2A depicts a cartridge 200 that is sized and shaped to snugly fit within the interior volume 115 of the reservoir 105. (In such embodiments, the longitudinal end of the reservoir 105 may be open in order to accommodate insertion of the cartridge 200.) As shown, the cartridge 200 defines a hollow slot 205 therewithin that may be utilized to contain a volume of the precursor solution when the cartridge is inserted within the reservoir 105. FIG. 2B depicts the cartridge 200 inserted within the reservoir 105 and oriented such that the slot 205 is not fluidly coupled to the openings 115. As shown, the slot 205 contains a volume of precursor solution 210, which may be introduced into the slot 205 via the inlet 110. In other embodiments, the precursor solution 210 may be introduced into the slot 205 prior to insertion of the cartridge 200 into the reservoir 105. (In such embodiments, the inlet 110 may even be omitted.) In the configuration of FIG. 2B, electrospinning does not yet take place because the precursor solution 210 cannot exit through the openings 115. In various embodiments, one or more seals (e.g., o-rings) may be utilized to form a seal between the cartridge 200 and the reservoir 105 to, e.g., prevent exposure of the precursor solution 210 to oxygen while within the reservoir 105.

Figure 2C:
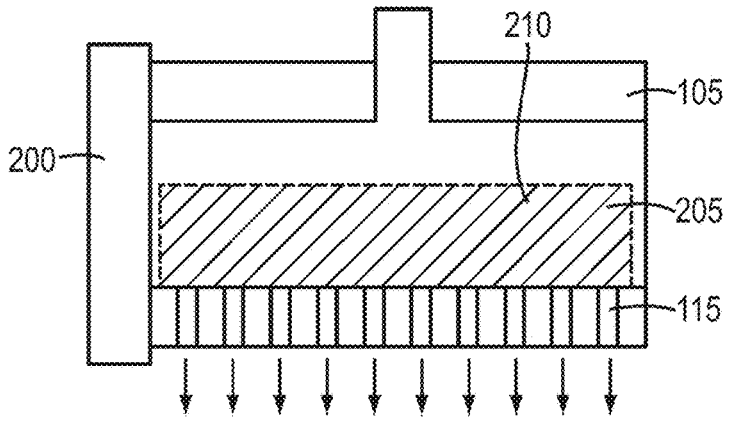

Once the cartridge 200 and precursor solution 210 are disposed within the reservoir 105 as shown in FIG. 2B, electrospinning may be initiated via rotation of the cartridge 200 such that the slot 205 is fluidly coupled to the openings 115, allowing the precursor solution 210 to drip onto the needles 120. FIG. 2C depicts this rotated configuration. In this manner, controlled volumes of precursor solution 210 may be utilized to form electrospun fibers when and only when the cartridge 200 is rotated within the reservoir 105. The electrospinning process may be terminated at any time, even if precursor solution 210 remains within slot 205, via rotation of the cartridge 200 such that the slot 205 is no longer fluidly coupled to the openings 115 (e.g., to the configuration depicted in FIG. 2B).

The material of the cartridge 200 is not particularly limited, although in various embodiments the cartridge 200 includes, consists essentially of, or consists of one or more materials that are unreactive to the particular precursor solution utilized to form electrospun fibers. In various embodiments, the cartridge 200 may include, consist essentially of, or consist of a polymeric or plastic material such as a fluoropolymer, e.g., polytetrafluoroethylene (PTFE). In various embodiments, the cartridge 200 is electrically insulating, such that electrical charge does not prematurely begin the electrospinning process while the solution is contained within the cartridge 200. In various embodiments, the cartridge 200 and the reservoir 105 include, consist essentially of, or consist of the same material, while in other embodiments the cartridge 200 and the reservoir 105 include, consist essentially of, or consist of different materials.

Figure 3A:
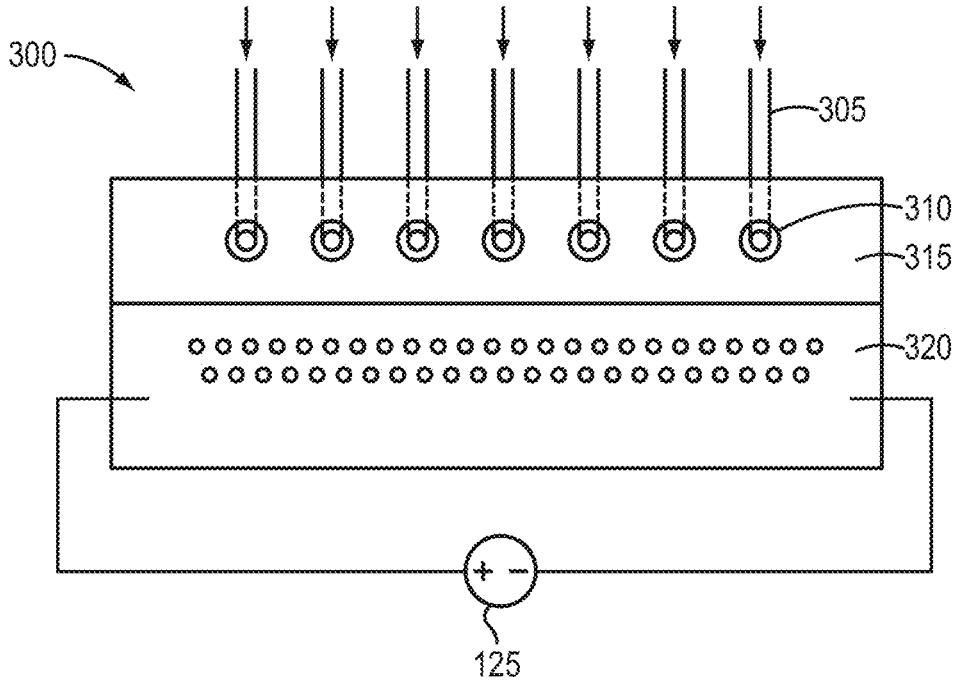
FIG. 3A is a schematic front view of an electrospinning apparatus in accordance with embodiments of the present invention.
Figure 3B:
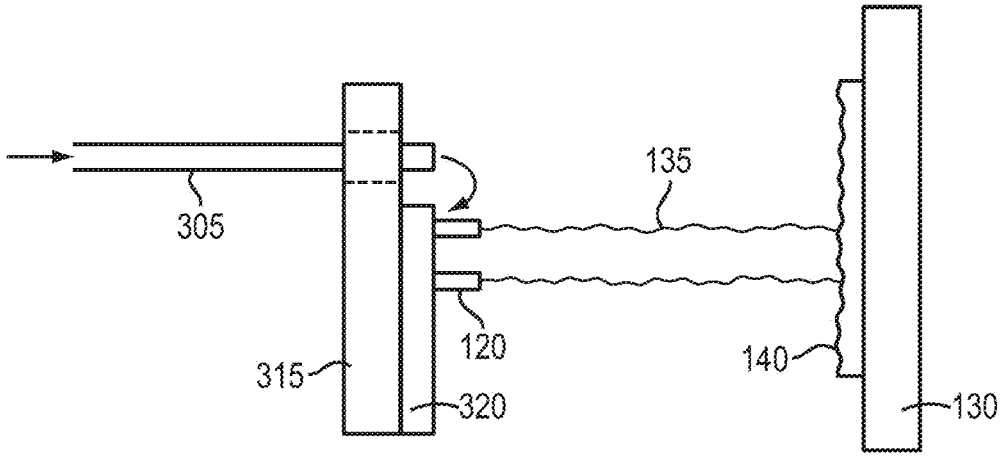
FIG. 3B is a schematic side view of the electrospinning apparatus of FIG. 3A.

FIGS. 3A and 3B are front-view and side-view schematics, respectively, of an electrospinning apparatus 300 in accordance with embodiments of the present invention. As shown, the apparatus 300 features one or more hollow tubes 305 into which a precursor solution (e.g., a sol-gel) is disposed for electrospinning of fibers. In various embodiments, the hollow tubes 305 are fluidly coupled to a source of the precursor solution, for example a holding tank (not shown). Flow of the precursor solution, which may be caused by one or more pumps, may be manually or automatically controlled via, e.g., one or more valves. After the precursor solution is supplied into the hollow tubes 305, it drips or slowly flows through the ends of the tubes 305 onto a series of needles 120. In various embodiments, the precursor solution drips through the tubes 305 via the force of gravity and without additional fluid pressure exerted on the solution. In other embodiments, the precursor solution is urged through the tubes 305 by fluid pressure from the holding tank or via other pressure applied to the solution.

As shown in FIGS. 3A and 3B, the hollow tubes 305 may be positioned within or slightly protrude from openings 310 defined in a support 315. The support 315 may be electrically conductive or electrically insulating. The needles 120 may be mounted directly on the support 315 in embodiments in which the support 315 is electrically conductive, in order to facilitate supply of voltage to the needles 120 for an electrospinning process. In other embodiments, the needles are mounted on an electrically conductive needle platform 320 that is coupled to the face of the support 315.

As described above in relation to FIG. 1, the needles 120 are electrically coupled (e.g., via needle platform 320) to high-voltage source 125, which may supply a voltage of, for example approximately 5 kV to approximately 50 kV. The needles 120 point toward the collector 130. In various embodiments, the collector 130 is maintained at a voltage different from (e.g., less than) that of the needles 120; for example, the collector 130 may be electrically grounded. In various embodiments, the collector 130 may be a wall or other surface.

Figure 3C:
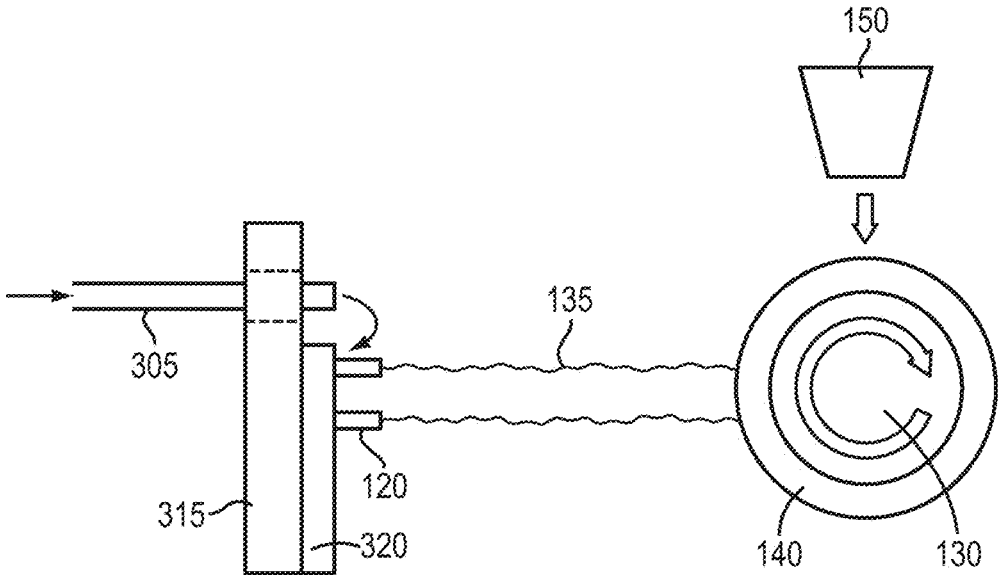
FIG. 3C is a schematic side view of an electrospinning apparatus in accordance with embodiments of the present invention.

FIG. 3C schematically depicts a variant of the electrospinning apparatus in which the collector 130 is a rotatable drum. As shown, the drum may rotate during fiber spinning along an axis of rotation approximately perpendicular to the spinning direction extending from the needles 120 to the collector 130. The fiber mat 140 then collects on the periphery of the drum during rotation thereof. In various embodiments, the electrospinning apparatus also includes a blower 150 which blows air (or another gas) onto the fiber mat 140 during spinning, so that the mat 140 forms with a substantially consistent thickness along the length of the drum. That is, the air (or other gas) from the blower 150 ensures that the electrospun fibers are deposited evenly across the drum and eliminates or minimizes any spots along the length of the drum where the fibers may collect at a lesser or greater thickness. In various embodiments, the blower 150 may include, consist essentially of, or consist of one or more nozzles through which the air is blown. The nozzles may be distributed along one or more rows parallel to the long axis of the collector drum. In various embodiments, the blower 150 may include one or more elongated nozzles or outlets having widths approximately equal to that of the collector drum (or at least the portion thereof over which the fiber mat is meant to be collected), creating an "air knife" or "air blade" blower system. In various embodiments, the blower 150 may also include an air compressor and/or a connection to a source of compressed gas, as well as one or more conduits for conducting the gas to the one or more nozzles. In various embodiments, the blower 150 may instead or additionally be utilized to spray or mist one or more additives onto the fibers during and/or after electrospinning thereof. Although the blower 150 is depicted in FIG. 3C as positioned above the collector drum 130 and blowing air downward, in other embodiments the blower 150 may be disposed in different positions. For example, the blower 150 may be disposed behind the collector drum 130 (i.e., opposite the direction from which the fibers are spun from the needles) and may blow air horizontally onto the fiber mat 140 on the collector drum. In various embodiments, the electrospinning apparatus may include multiple blowers disposed at different positions, and the multiple blowers may blow air simultaneously, or one at a time, in order to maintain a substantially consistent (e.g., the same thickness±10%, ±5%, ±2%, or ±1%) thickness of the fiber mat 140 along the drum.

In various embodiments, as the precursor solution drips onto the needles 120, the high voltage between the needles 120 and the collector 130 forms charged fluid jets at the needles 120 that solidify into fibers 135. Thus, in embodiments of the present invention, the precursor solution drips, through free space, toward and/or onto the needles 120, rather than being supplied to tips of the needles 120 through the needles 120 themselves (e.g., via hollow lumens within the needles). The fibers 135 deposit onto the collector 130, for example as a fiber mat (e.g., a non-woven mat) 140. The fibers may be harvested from the collector 130 for use in a host of different applications. As described above, the needles 120 may be angled substantially horizontally, as shown in FIG. 3B, and/or in one or more other directions, and one or more of the needles 120 may be angled in a direction different from that which one or more others of the needles 120 are angled.

The material of the tubes 305 is not particularly limited, although in various embodiments the tubes 305 includes, consists essentially of, or consists of one or more materials that are unreactive to the particular precursor solution utilized to form electrospun fibers and that are electrically insulating. In various embodiments, the tubes 305 may include, consist essentially of, or consist of a polymeric or plastic material. In various embodiments, the tubes 305 are electrically insulating, such that electrical charge does not prematurely begin the electrospinning process while the solution is contained within the tubes 305.

In various embodiments, the support 315 and needles 120 may be disposed on a movable platform that is movable parallel to the collector 130. In this manner, the length along the collector 130 of the resulting fiber assemblage may be increased without increasing the number of needles 120. In various embodiments, the collector 130 may itself be movable (e.g., translatable and/or rotatable) in order to increase the areal size of the assemblage (e.g., mat) of electrospun fibers. The thickness of the electrospun mat may be largely dependent upon the amount of precursor solution utilized for spinning and thus the amount of electrospinning time. For example, the mat may have a thickness of greater than about ⅛ inch, or greater than about ¼ inch, or greater than about ⅓ inch, or greater than about ½ inch.

In various embodiments of the invention, the tubes 305 are fluidly connected to a holding tank containing a larger volume of the precursor solution, and the introduction of the precursor solution into the tubes 305 is controlled by one or more valves and/or one or more pumps.

In various embodiments, after electrospinning of fibers 135, the tubes 305 may be cleaned by, for example, introducing water and/or a cleaning solution into the tubes 305. The fluid may be pressurized to force the fluid through the tubes 305 to ensure removal of any remnant precursor solution. Such cleaning cycles may prevent crystallization or solidification of the precursor solution that might clog or block the tubes 305. In other embodiments, the tubes 305, or portions thereof, may simply be replaced at various intervals. For example, if the distal ends of the tubes 305 experience clogging or blockage, the tubes 305 may be fed farther through the holes in the support 315 and simply removed (e.g., by cutting); thus, the same tubes 305 may be utilized for electrospinning multiple times, and be cut to smaller and smaller lengths, before full replacement thereof.

In various embodiments, any gelatinous or solid material that forms and/or builds up on the needles 120 may be removed by periodic cleaning. For example, the needles 120 may be brushed, during and/or after the application of charge to the needles 120 (e.g., during an electrospinning process) to remove such extraneous material and facilitate contact of newly dripped solution onto the needles 120. In various embodiments of the present invention, the electrospinning apparatus includes a cleaning system that periodically or on demand cleans the needles 120 (e.g., via brushing). For example, a platform containing one or more brushes or wipers may be mounted below the needles 120 and moved up to the needles 120 periodically to clean any residue therefrom.

Figure 3D:
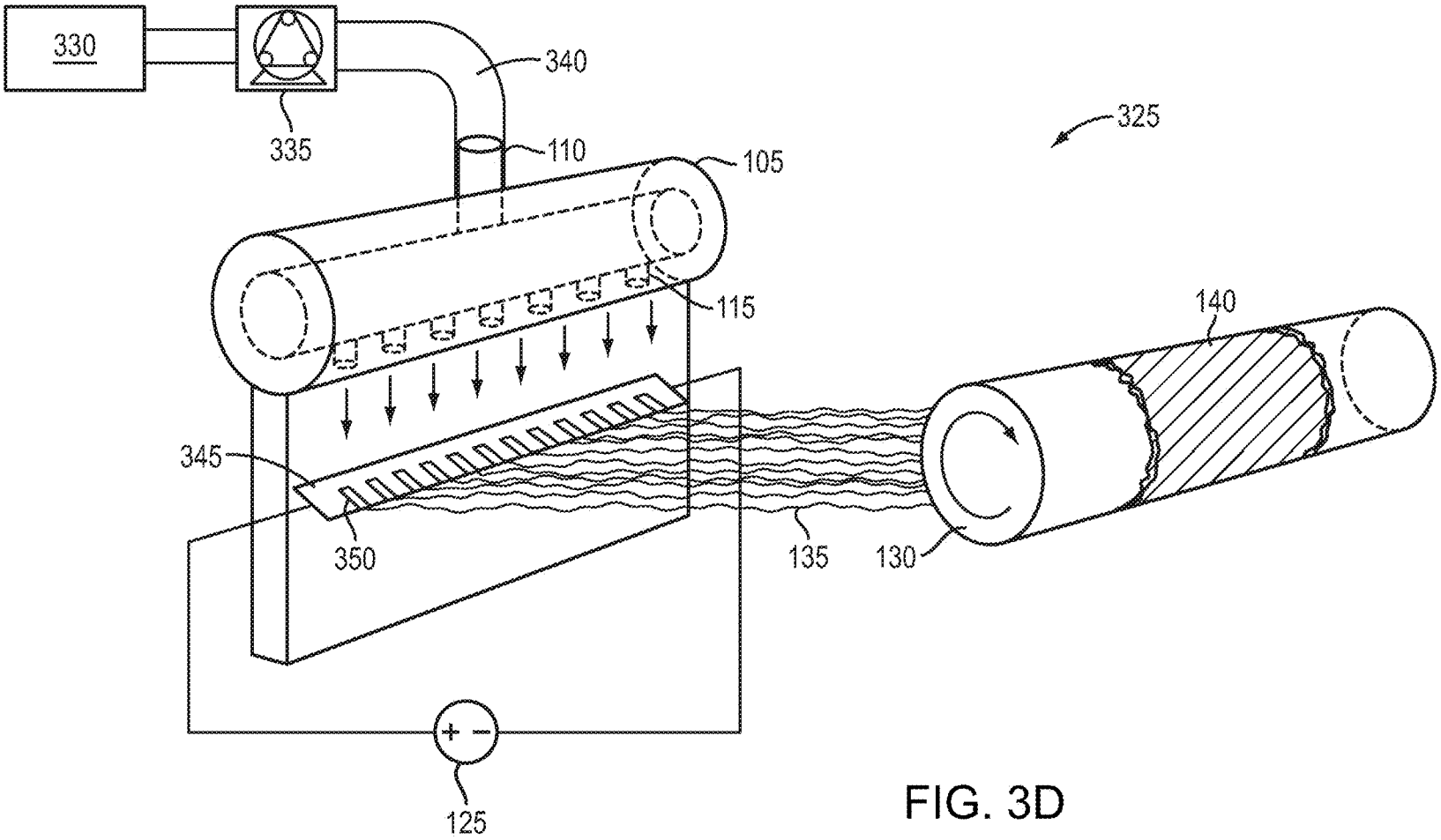
FIG. 3D is a schematic diagram of an electrospinning apparatus in accordance with embodiments of the present invention.
Figure 4A:
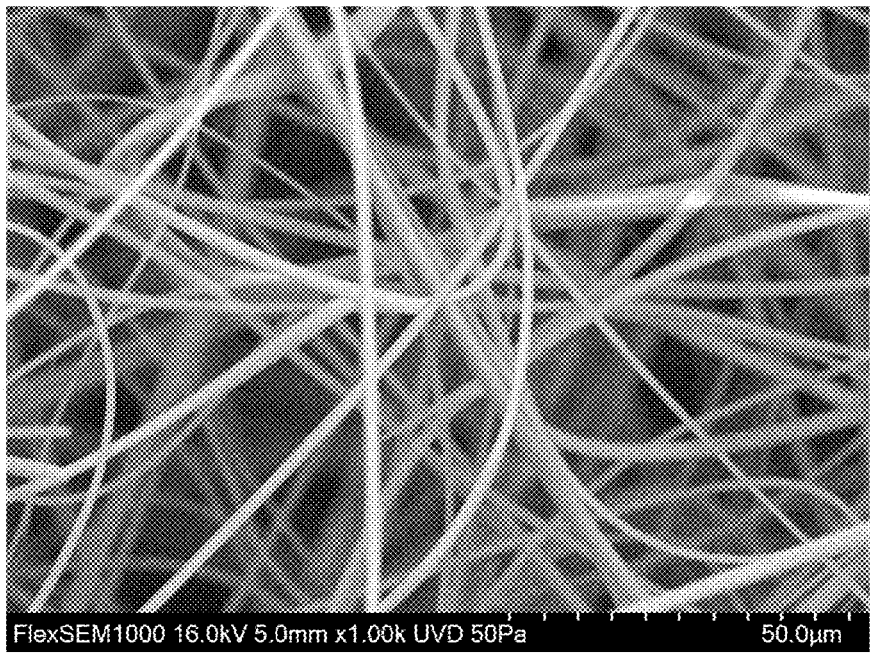
FIGS. 4A-4D are scanning electron microscopy (SEM) images of fibers spun in accordance with embodiments of the present invention. Images in FIGS. 4A-4D are at, respectively, 50, 100, 200, and 500 micron scale.
Figure 4B:
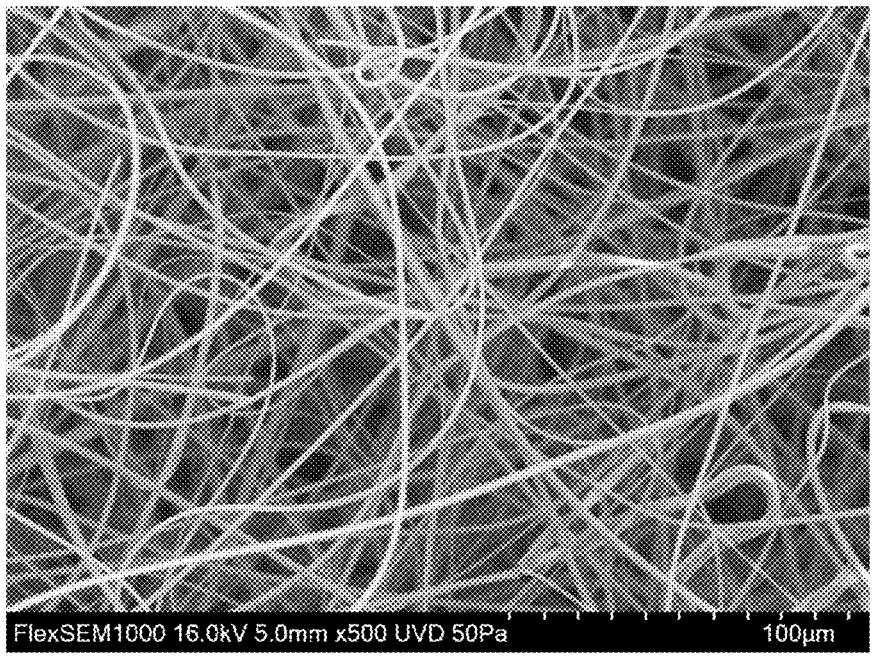
Figure 4C:
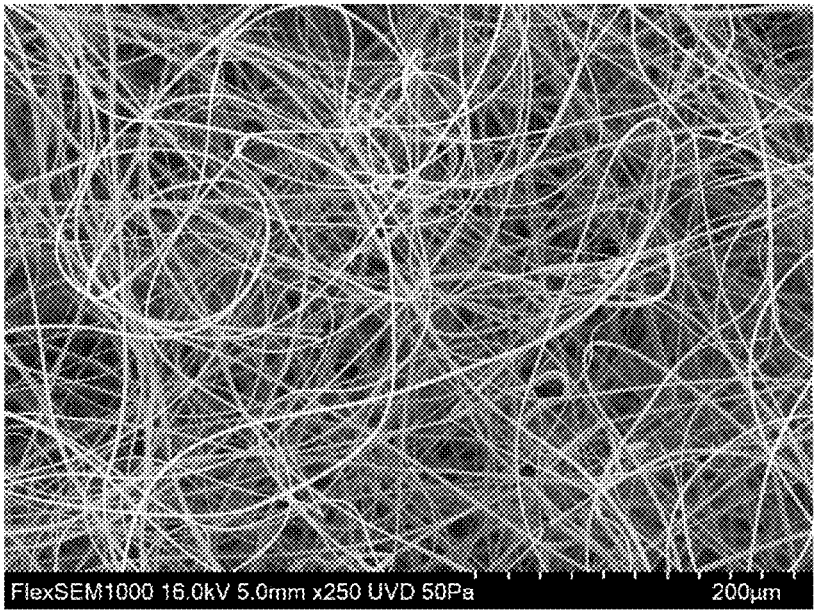
Figure 4D:
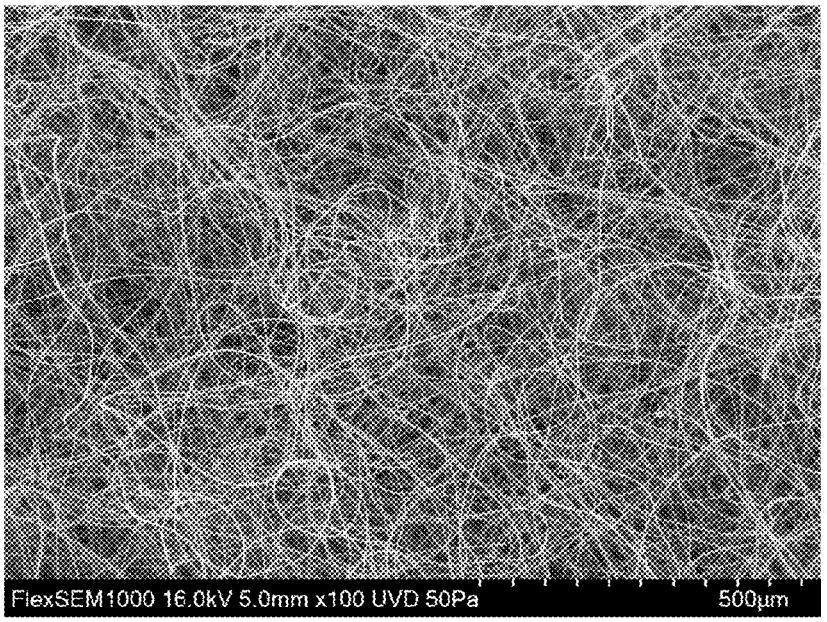

FIG. 3D is a schematic diagram of an electrospinning apparatus 325 in accordance with embodiments of the present invention. As shown, the apparatus 325 features the hollow reservoir or manifold 105 into which a precursor solution (e.g., a sol-gel) is disposed for electrospinning of fibers. In the depicted embodiment, the reservoir 105 is equipped with an inlet 110 for supplying the precursor solution, and the reservoir 105 also features a series of openings 115 in its bottom surface that are fluidly coupled to the interior volume of reservoir 105. In various embodiments, the openings 115 have a fairly small diameter, e.g., 1.5 mm-2 mm. As shown, the precursor solution is supplied from a holding tank 330 to the inlet 110, by a pump 335, via one or more conduits 340. In various embodiments, the reservoir 105 may have two or more inlets 110 each fluidly coupled to the holding tank 330 by a conduit 340.

In electrospinning apparatus 325, after the precursor solution is supplied into the interior volume of the reservoir 105, it drips or slowly flows through the openings 115 onto a conductive plate 345. As shown in FIG. 3D, in various embodiments, the plate 345 is typically tilted or angled such the solution flows to the front edge of the plate 345 due to the force of gravity. At the front edge of the plate 345, Taylor cones form in the solution due to the electric charge applied to the plate 345 by high-voltage source 125, and the solution jets away from the plate 345 to the collector 130, thereby forming electrospun fibers 135. In typical embodiments, the plate 345 includes, consists essentially of, or consists of one or more metallic materials, e.g., stainless steel, aluminum, and/or copper. In various embodiments, the front edge of the plate 345 is substantially straight and flat, while in other embodiments, the front edge of the plate 345 defines a series of protrusions. While such protrusions may facilitate formation of Taylor cones in predetermined locations, the protrusions are not necessary for successful electrospinning.

As detailed above with reference to FIG. 3C, the apparatus 325 may include blower 150. As shown in FIG. 3D and as mentioned above, the collector 130 may be a rotatable drum on which the assemblage 140 of fibers is deposited. In various embodiments, a series of recessed troughs 350 may be formed in the plate 345, at least at the front edge thereof, in order to facilitate spreading of the solution across the plate 345, but such recesses 350 are not required for successful electrospinning. Advantageously, after the electrospinning is complete, the plate 345 may simply be wiped clean or replaced, enabling resumption of electrospinning with high throughput and minimal downtime—the cleaning of the plate 345 tends to be faster than equivalent cleaning processes for apparatuses utilizing charged needles, increasing process throughput.

In various embodiments, the pump 335 is a peristaltic pump. In such embodiments, and as known to those of skill in the art, the components of the pump 335 are not directly exposed to the solution, as the pump 335 simply forces the solution through the tube 340 via a series of compressions by, e.g., one or more rollers or wipers. Advantageously, non-exposure of the pump 335 and its components to the solution obviates the need for excessive maintenance and cleaning of the pump 335, increasing up-time and throughput of the electrospinning apparatus 325.

As mentioned above, the conductive plate 345 is electrically coupled to the high-voltage source 125, which may supply a voltage of, for example approximately 5 kV to approximately 50 kV. The front surface of the angled conductive plate 345 faces toward the collector 130. In various embodiments, the collector 130 is maintained at a voltage different from (e.g., less than) that of the plate 345; for example, the collector 130 may be electrically grounded. In various embodiments, the collector 130 may be a wall or other surface, and in other embodiments, as shown in FIG. 3D, the collector 130 may be a rotatable drum. As shown, the drum may rotate during fiber spinning along an axis of rotation approximately perpendicular to the spinning direction extending from the plate 345 to the collector 130. The fiber mat 140 then collects on the outer surface of the drum during rotation thereof. In various embodiments, the electrospinning apparatus also includes the blower 150, as mentioned above.

In various embodiments, the reservoir 105 and the plate 345 may be disposed on a movable platform that is movable parallel to the collector 130. In this manner, the length along the collector 130 of the resulting fiber assemblage may be increased without increasing the size of the plate 345 or reservoir 105. In various embodiments, the collector 130 may itself be movable (e.g., translatable and/or rotatable) in order to increase the areal size of the assemblage (e.g., mat) of electrospun fibers. The thickness of the electrospun mat may be largely dependent upon the amount of precursor solution utilized for spinning and thus the amount of electrospinning time. For example, the mat may have a thickness of greater than about ⅛ inch, or greater than about ¼ inch, or greater than about ⅓ inch, or greater than about ½ inch.

In various embodiments, after electrospinning of fibers 135, the reservoir 105 and openings 115 may be cleaned by, for example, introducing water and/or a cleaning solution into the reservoir 105 via inlet 110. The fluid may be pressurized to force the fluid through the openings 115 to ensure removal of any remnant precursor solution. Such cleaning cycles may prevent crystallization or solidification of the precursor solution that might clog or block the openings 115.

In various embodiments, any gelatinous or solid material that forms and/or builds up on the plate 345 may be removed by periodic cleaning. For example, the plate 345 may be brushed, during and/or after the application of charge to the plate 345 (e.g., during an electrospinning process) to remove such extraneous material and facilitate contact of newly dripped solution onto the plate 345. In various embodiments of the present invention, the electrospinning apparatus includes a cleaning system that periodically or on demand cleans the plate 345 (e.g., via brushing). For example, a platform containing one or more brushes or wipers may be mounted below or to the side of the plate 345 moved to the plate 345 periodically to clean any residue therefrom.

In various embodiments, the electrospinning apparatus, blower 150, cleaning system, and/or sol-gel supply system (e.g., one or more pumps, holding tanks, etc.) may be controlled by a computer-based control system (or "controller"). For example, the control system may operate the electrospinning apparatus for particular amounts or time and/or in response to user-provided recipes. The control system may control the movement of the needles 120 or plate 345 relative to the collector 130, as well as the rotation speed of collector 130 when collector 130 is a rotatable drum. The control system may control the flow rate of the solution supplied to the needles 120 or plate 345, as well as the amount and application of the high voltage between the needles 120 or plate 345 and the collector 130. The control system may also control the blower 150, e.g., the amount and/or timing of air blown onto the fiber mat 140, as well as to control the spraying of one or more additives onto the fiber mat 140. For example, the control system may be responsive to data and/or feedback obtained by one or more optical sensors that detect the shape and/or thickness of the fiber mat along the length of the collector, and the control system may activate, deactivate, and/or control the flow rate and/or position of the air (or other gas) blown onto the collector drum to reduce any detected thickness variations along the fiber mat. The control system may be responsive to recipes stored in a computer memory and/or to manual control by an operator (e.g., via various buttons, switches, etc.).

The controller may be provided as either software, hardware, or some combination thereof. For example, the system may be implemented on one or more conventional server-class computers, such as a PC having a CPU board containing one or more processors such as the Pentium or Celeron family of processors manufactured by Intel Corporation of Santa Clara, Calif., the 680×0 and POWER PC family of processors manufactured by Motorola Corporation of Schaumburg, Ill., and/or the ATHLON line of processors manufactured by Advanced Micro Devices, Inc., of Sunnyvale, Calif. The processor may also include a main memory unit for storing programs and/or data relating to the methods described herein. The memory may include random access memory (RAM), read only memory (ROM), and/or FLASH memory residing on commonly available hardware such as one or more application specific integrated circuits (ASIC), field programmable gate arrays (FPGA), electrically erasable programmable read-only memories (EEPROM), programmable read-only memories (PROM), programmable logic devices (PLD), or read-only memory devices (ROM). In some embodiments, the programs may be provided using external RAM and/or ROM such as optical disks, magnetic disks, as well as other commonly used storage devices. For embodiments in which the functions are provided as one or more software programs, the programs may be written in any of a number of high level languages such as FORTRAN, PASCAL, JAVA, C, C++, C#, BASIC, various scripting languages, and/or HTML. Additionally, the software may be implemented in an assembly language directed to the microprocessor resident on a target computer; for example, the software may be implemented in Intel 80×86 assembly language if it is configured to run on an IBM PC or PC clone. The software may be embodied on an article of manufacture including, but not limited to, a floppy disk, a jump drive, a hard disk, an optical disk, a magnetic tape, a PROM, an EPROM, EEPROM, field-programmable gate array, or CD-ROM.

In various embodiments, the fibers of an electrospun collection of fibers or fiber mat are preferentially oriented in a particular direction, and the electrospinning apparatus may be configured to enable electrospinning of oriented fibers. For example, as detailed in U.S. Pat. No. 7,993,567, filed Jun. 2, 2008, the entire disclosure of which is incorporated by reference herein, the electrospinning apparatus may incorporate one or more auxiliary electrodes proximate the collector and, e.g., opposite the electrically charged needles or plate 345. Such electrodes may shape the electric field proximate the collector such that the electrospun fibers are deposited with a preferred orientation rather than as a random mat. The oriented fibers may then be utilized in a desired application with the fiber orientation aligned to a particular direction.

In various embodiments, one or more additives are introduced onto the fibers during the electrospinning process. For example, a slurry containing the material (e.g., in powder or particulate form) may be sprayed or misted onto the fibers between the needles 120 or plate 345 and the collector 130 or as formed on the collector 130 itself. In various embodiments, the slurry contains one or more additives selected for a particular application or device in solution with a carrier such as water and/or an organic liquid.

In various embodiments, one or more additives may be added into the sol-gel, for example in particulate or powder form, or as a slurry or mixture, prior to spinning of the fibers, and the as-spun fibers will incorporate the additive therein or thereon. In various embodiments, the additive is added into the sol-gel after at least a portion of the ripening time.

In other embodiments, one or more additives are incorporated onto the fibers and/or powder after the fibers or fiber mats are spun. After completion of the electrospinning process, the resulting mat is removed from the collector 130. For example, the mat may be cut and peeled away from the collector in one or more pieces. The mat may be cut to size, if desired or necessary, and the electrospun mat of fibers may be coated with one or more additives. For example, an additive may be deposited over the fibers via techniques such as electrodeposition from a solution containing the additive, atomic layer deposition, chemical vapor deposition, or spraying or misting of a solution containing one or more additives selected for the desired application along with a carrier such as water and/or a polymeric binder. In various embodiments, the fibers or mat is processed into powder, and the additive is deposited on the powder (via, e.g., any of the above techniques) and/or mixed with the powder.

Embodiments of the invention may be utilized with any of a host of different precursor solutions or sol-gels to form electrospun fibers including, consisting essentially of, or consisting of many different materials. In an illustrative embodiment, the apparatus 100 may be utilized to electrospin silica fibers from a sol-gel. In such an example embodiment, a sol-gel for electrospinning of silica fibers is prepared by a method that includes preparing a first mixture containing an alcohol solvent, a silicon alkoxide reagent such as tetraethyl ortho silicate (TEOS); preparing a second mixture containing an alcohol solvent, water, and an acid catalyst; fully titrating the second mixture into the first mixture; and processing (ripening) the combined mixture under controlled environmental conditions to form a gel for electrospinning.

In some embodiments, the silicon alkoxide reagent is TEOS. Alternative silicon alkoxide reagents include those with the formula $Si(OR)_4$, where R is from 1 to 6, and preferably 1, 2, or 3.

In some embodiments, the alcohol solvent is an anhydrous denatured ethanol, or in some embodiments, methanol, propanol, butanol or any other suitable alcohol solvent. The first mixture can be agitated, for example, using a magnetic stirrer or similar agitation means. The second mixture contains an alcohol solvent, water, and an acid catalyst. The alcohol solvent may be an anhydrous denatured alcohol, or may be methanol, propanol, butanol or any other suitably provided alcohol solvent. Water may be distilled water or deionized water. Enough acid catalyst is added to the mixture to aid in the reaction. This acid catalyst may be hydrochloric acid, or may be sulfuric acid or other suitable acid catalyst. The second mixture may be agitated, for example, with a magnetic stirrer or other agitation means. In some embodiments, the first mixture (or sol) and the second mixture (or sol) are created without the use of direct heat (i.e., heat applied via extrinsic means such as a hot plate or other heat source).

In some embodiments, the sol comprises, consists essentially of, or consists of about 70% to about 90% by weight silicon alkoxide (e.g., TEOS), about 5% to about 25% by weight alcohol solvent (e.g., anhydrous ethanol), an acid catalyst (e.g., less than about 0.1% by weight when using HCl) and water. Any sol or sol-gel described herein may include the balance water (i.e., water may constitute any amount of the sol or sol-gel that is otherwise unspecified). Any sol or sol-gel described herein may optionally contain one or more reagents or additives that may or do alter one or more properties of the sol, the sol-gel, and/or the fibers (and/or powder prepared therefrom). (In various embodiments, such additives may be sprayed or misted on the spun or spinning fibers as described herein.) Such reagents may include, but are not limited to, for example, polymers and polymeric solutions, inert reagents, alcohols, organic and/or aqueous solvents, organic salts, inorganic salts, metals, metal oxides, metal nitrides, metal oxynitrides, carbon (e.g., graphene, graphite, amorphous carbon, fullerenes, etc.), healing agents, etc.

In some embodiments, the sol contains 70% to 90% tetraethyl orthosilicate (TEOS) by weight, 8% to 25% ethanol by weight, 1% to 10% water by weight, and an acid catalyst. In some embodiments, the sol contains 75% to 85% by weight TEOS, 12% to 20% by weight ethanol, and about 2% to 5% by weight water. An exemplary sol contains about 80% by weight TEOS, about 17% by weight ethanol, and about 3% by weight water. In some embodiments, the acid catalyst is HCl. For example, the sol may contain less than about 0.1% HCl by weight. For example, the sol may contain from 0.02% to 0.08% HCl by weight. In various embodiments, the sol does not contain an organic polymer, or other substantial reagents, such that the fiber composition will be substantially pure $SiO_2$. In various embodiments, the sol does not include inorganic salts (e.g., sodium chloride, lithium chloride, potassium chloride, magnesium chloride, calcium chloride, and/or barium chloride), nor are, in various embodiments, inorganic salts mixed with other components of the sol or into the sol itself. In various embodiments, the fiber composition does not include metals or metal oxides (e.g., $TiO_2$ or $ZrO_2$). In various embodiments, the fiber composition consists essentially of $SiO_2$, i.e., contains only $SiO_2$ and unintentional impurities, and, in some embodiments, species and/or complexes resulting from the incomplete conversion of the sol to $SiO_2$ (e.g., water and/or chemical groups such as ethoxy groups, silanol groups, hydroxyl groups, etc.). In various embodiments, additives may be incorporated onto silica fibers and or powder prepared therefrom after the electrospinning process.

According to various embodiments, the first mixture and the second mixture are combined by dripping or titrating the second mixture into the first mixture, preferably with agitation. The combined mixture is then further processed by allowing the sol to ripen in a controlled environment until a substantial portion of the alcohol solvent has evaporated to create a sol-gel suitable for electrospinning. For example, the controlled environment may include an enclosure with at least one vent and optionally a fan to draw gases away from the mixture, and which may involve controlled conditions in terms of humidity, temperature, and optionally barometric pressure. For example, the humidity may be controlled (e.g., via use of conventional humidifiers and/or dehumidifiers) within the range of about 30% to about 90%, such as from about 40% to about 80%, or in some embodiments, from about 50% to about 80%, or from about 50% to about 70% (e.g., about 55%, or about 60%, or about 65%). Some humidity may be helpful to slow evaporation of solvent, and thereby lengthen the window for successful electrospinning. In some embodiments, the temperature is in the range of from about 50° F. to about 90° F., such as from about 60° F. to about 80° F., or from about 65° F. to about 75° F. In various embodiments, the sol is not exposed to heat over 150° F. or heat over 100° F., so as to avoid accelerating the transition. In some embodiments, barometric pressure is optionally controlled (e.g., using a low pressure vacuum source such as a pump or a fan). By controlling the environmental conditions during ripening, the time period during which the gel may be electrospun may be lengthened; this time period may be a small window of only several minutes if the ripening process is too accelerated, such as with direct heat. When ripening the sol at a constant humidity of about 55% and temperature of about 72° F., the sol will ripen (gelatinize) in a few days, and the window for successful electrospinning may be expanded to at least several hours, and in some embodiments several days. In various embodiments, the ripening process takes at least 2 days, or at least 3 days in some embodiments. However, in various embodiments the ripening does not take more than 10 days, or more than 7 days. In some embodiments, the ripening process takes from 2 to 10 days, or from 2 to 7 days, or from 2 to 5 days, or from 2 to 4 days (e.g., about 2, about 3, or about 4 days). In various embodiments, the sol-gel is spinnable well before it transitions into a more solidified, non-flowable mass.

The enclosure space for ripening the sol-gel may include a vent on at least one surface for exhausting gases from within the enclosure, and optionally the vent may include a fan for exhausting gases produced during the ripening process. The enclosure space may optionally include a heating source (e.g., one or more heating elements, for example resistive heating elements) for providing a nominal amount of heat within the enclosure space, to maintain a preferred temperature. In some embodiments, a source of humidity (e.g., an open container of water or other aqueous, water-based liquid) is provided within the enclosure environment to adjust the humidity to a desired range or value. The enclosure may further include one or more environmental monitors, such as a temperature reading device (e.g., a thermometer, thermocouple, or other temperature sensor) and/or a humidity reading device (e.g., a hygrometer or other humidity sensor).

In some embodiments, the sol-gel is electrospun after a ripening process of at least 2 days, or at least 36 hours, or at least 3 days, or at least 4 days, or at least 5 days at the controlled environmental conditions (but in various embodiments, not more than 10 days or not more than 7 days under the controlled environmental conditions). By slowing the ripening process, the ideal time to spin the fibers can be identified. The weight of the sol-gel can be used as an indicator of when the sol-gel is at or near the ideal time to electrospin. Without intending to be bound by theory, it is believed that the viscosity of the sol-gel is a poor determinant for identifying the optimal time for electrospinning. For example, in various embodiments, the sol-gel is from about 10% to about 60% of the original weight of the sol (based on loss of alcohol solvent during transitioning). In some embodiments, the sol-gel is from 15 to 50% of the original weight of the sol, or in the range of about 20 to about 40% of the original weight of the sol.

In some embodiments, the sol-gel is ripened for at least 2 days, or at least 36 hours, or at least 3 days, or at least 4 days, or at least 5 days, and is electrospun when the ethylene vapors produced by the composition are between about 10% and about 40% of the vapors produced by the starting sol, such as in the range of about 10% and about 25%, such as in the range of about 10 to about 20%. Ethylene is a colorless flammable gas with a faint sweet and musky odor (which is clearly evident as solvent evaporation slows). Ethylene is produced by the reaction of ethanol and acid. Ethylene can optionally be monitored in the vapors using a conventional ethylene monitor. In other embodiments, gases produced by the sol during the sol ripening process are monitored to determine the suitable or optimal time for electrospinning. Gas profiles may be monitored using gas chromatography.

In various embodiments, one or more additives may be introduced into the sol-gel prior to electrospinning, and such additives may therefore be incorporated into and/or onto the spun fibers. In various embodiments, the additive is introduced into the sol-gel immediately prior to (e.g., less than 0.5 hour before, less than 1 hour before, less than 2 hours before, or less than 5 hours before) electrospinning so that the sol-gel successfully ripens prior to introduction of the additive, facilitating successful electrospinning. In various embodiments, the additive may be introduced into the sol-gel after it has ripened for at least 0.5 days, at least 1 day, at least 2 days, or at least 3 days.

In various embodiments, the sol-gel may be ripened for a shorter period of time, as long as the sol-gel remains spinnable via electrospinning. The resulting silica fiber mat may in some cases be more brittle after ripening for a shorter time period, but such brittleness may expedite the fragmenting of the mat for dispersion into various different compositions or devices. For example, the mat may be cut and peeled away from the collector in one or more pieces. The mat may then be fragmented to form a powder. In various embodiments, the powder includes, consists essentially of, or consists of small fibrous fragments that are each intertwined collections of silica fibers, rather than unitary solid particles. In some embodiments, the electrospun mat may be fractured, cut, ground, milled, or otherwise divided into small fragments that maintain a fibrous structure. In some embodiments, the mat (or one or more portions thereof) is rubbed through one or more screens or sieves, and the mesh size of the screen determines, at least in part, the size of the resulting fibrous fragments or powder or dust produced from the electrospun mat. For example, the mat or mat portions may be rubbed through a succession of two or more screens having decreasing mesh sizes (e.g., screens having mesh numbers of 100, 200, 300, or even 400), in order to produce a powder or dust or collection of fibrous fragments having the desired sizes.

The processing of the sol-gel mixture may require stirring or other agitation of the mixtures at various intervals or continuously due to the development of crystalline material on the top surface of the mixtures. This development of crystalline material on the top surface slows the processing time and it is believed that the crystalline material seals off exposure of the mixture to the gaseous vacuum provided within the enclosure space. In some embodiments, any solid crystalline material is removed from the mixture prior to electrospinning.

EXAMPLES

Example 1: Preparation of Silica Fiber Mat

Silica fibers were prepared using an electrospinning apparatus as detailed herein and via a process in which a sol-gel was spun onto a collector drum to form a non-woven mat of fibers. The sol-gel was made in two parts. First, TEOS was mixed with ethanol, and then a second mixture containing HCl, water, and ethanol was titrated into the mixture. The sol-gel was then allowed to ripen for a few days under controlled conditions before spinning.

In one example, the first sol was made by weighing out 384 grams of TEOS 98% and 41.8 grams of anhydrous denatured ethanol, and pouring together. The first sol was allowed to let stand in a beaker, and a magnetic stirrer was used to create a homogenous solution. The second sol was made by weighing 41.8 grams of anhydrous denatured ethanol, 16.4 grams of distilled water, and 0.34 grams of hydrochloric acid, which was then poured together and mixed for 8 seconds with a magnetic stirrer until a homogenous second sol was formed.

The second sol was then poured into the titration device, which was placed above a beaker containing the first sol. The titration device then dripped about 5 drops per second until a third sol was formed via the mixing of the first sol and the second sol. During the dripping process, the first sol was continuously mixed with a magnetic stirrer while the second sol was dripped into the first sol.

The combined third sol was then placed into an enclosure box. A low pressure vacuum was provided by a fan on medium speed to remove fumes. The air temperature within the box was 72° F. with 60% humidity. The third sol was allowed to sit and process for about three days. The mixtures were agitated daily to reduce the build-up of crystalline structures. The third sol began to transition to sol-gel with evaporation of the alcohol solvent. Sol-gel may be monitored to determine an approximate amount of $C_2H_4$ (ethylene) in the vapors, which may be in the range of about 10-20% relative to that of the original sol before ripening. Upon proper gelatinization, the sol-gel was loaded into the electrospinning apparatus (e.g., a holding tank or cartridge thereof) or was frozen to preserve for electrospinning. In this example, proper gelatinization occurred when the total mass of the sol-gel was between about 70 grams and about 140 grams. This example may be scaled appropriately and the ranges may vary, yet still produce desirable structures. To further identify the ideal (or a desired) time to electrospin, portions of the gel may be dripped into the electric field of the spinning apparatus to evaluate the spinning properties of the sol-gel.

Figure 5:
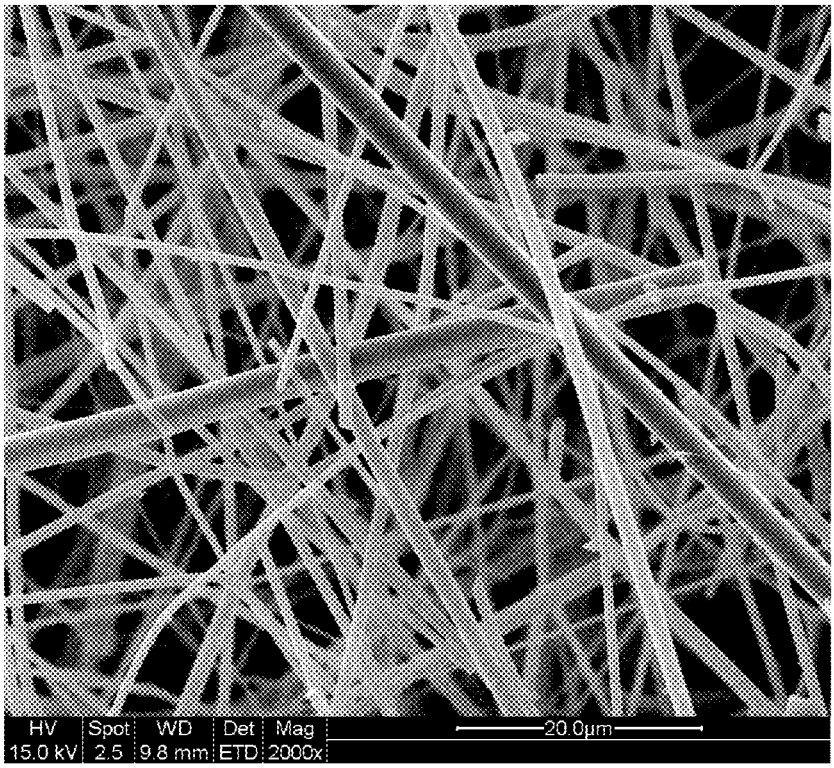
FIG. 5 shows an SEM image (20 micron scale is shown) of fibers spun in accordance with embodiments of the present invention after less ripening time than the figures shown in FIGS. 4A-4D.
Figure 6:
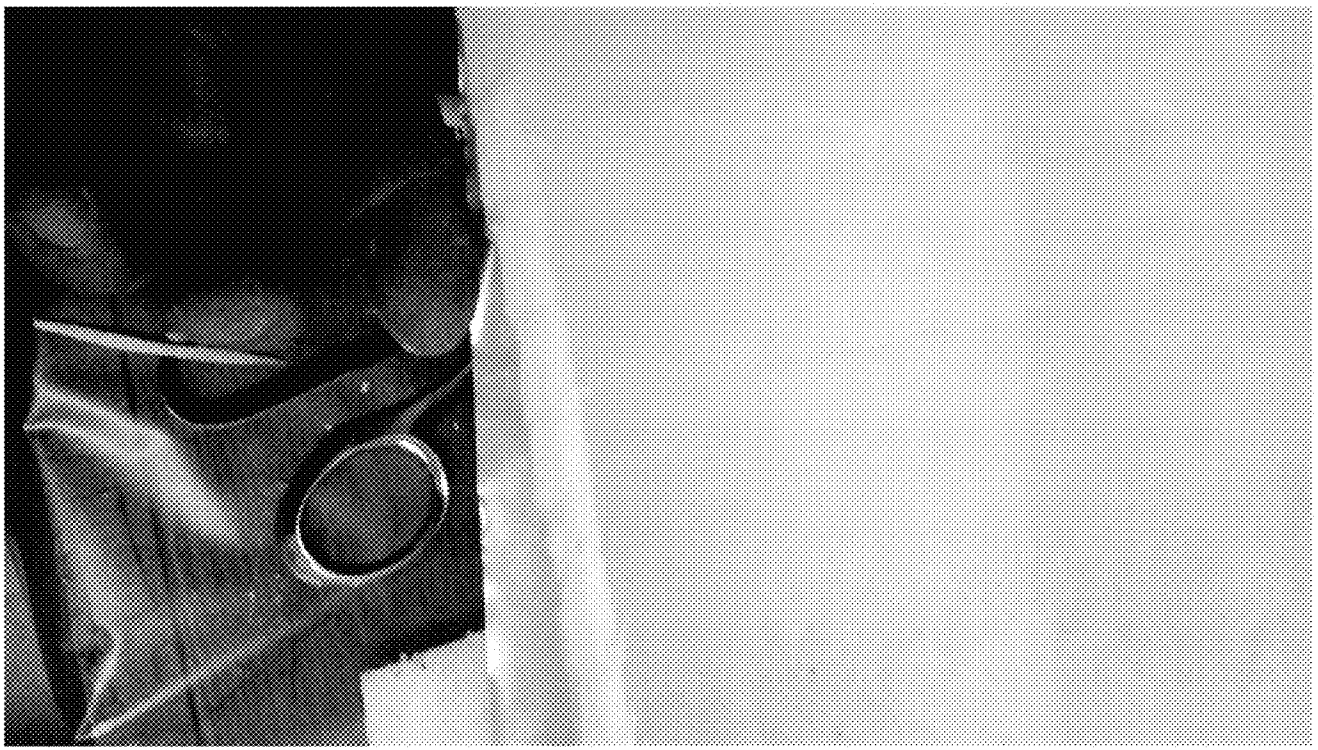
FIG. 6 shows a fiber mat spun with a thickness of about ¼ inch in accordance with embodiments of the present invention.

FIGS. 4A-4D are scanning electron microscopy (SEM) images of fibers spun in accordance with embodiments of the invention (50, 100, 200, and 500 micron scales shown). As shown, the fibers are flexible, smooth, dense, and continuous (not significantly fractured). FIG. 5 is an SEM image of fibers that were electrospun after less ripening time (20 micron scale shown), where the fibers are clearly rigid with many fractures clearly evident. Such fibers, in various embodiments, may be more brittle and more easily processed into silica fiber powder. FIG. 6 shows a fiber mat spun in accordance with embodiments of the invention. The flexibility and continuity of the fibers allows mats to be spun at a thickness of ¼ inch or more. The mat has a soft, flexible texture.

Figure 7A:
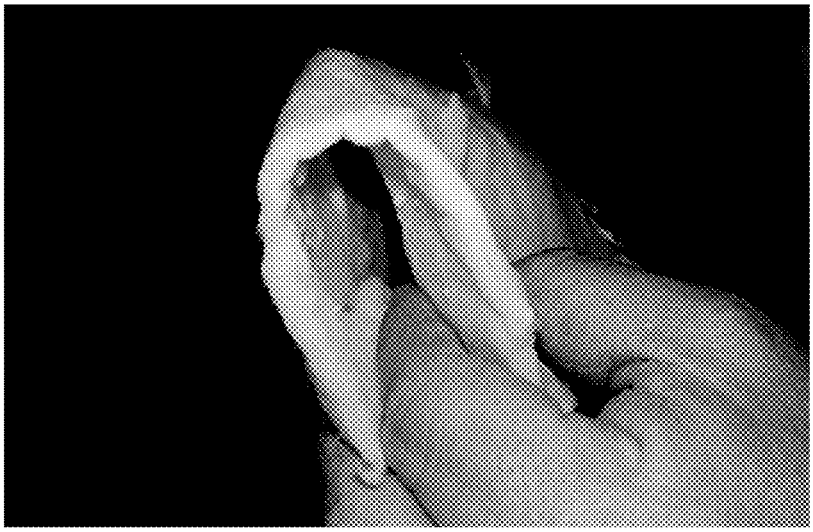
FIGS. 7A and 7B compare a fiber mat that was electrospun after a longer transitioning time in accordance with embodiments of the present invention (FIG. 7A), with a fiber mat electrospun after a shorter transition time in accordance with other embodiments of the present invention (FIG. 7B).
Figure 7B:
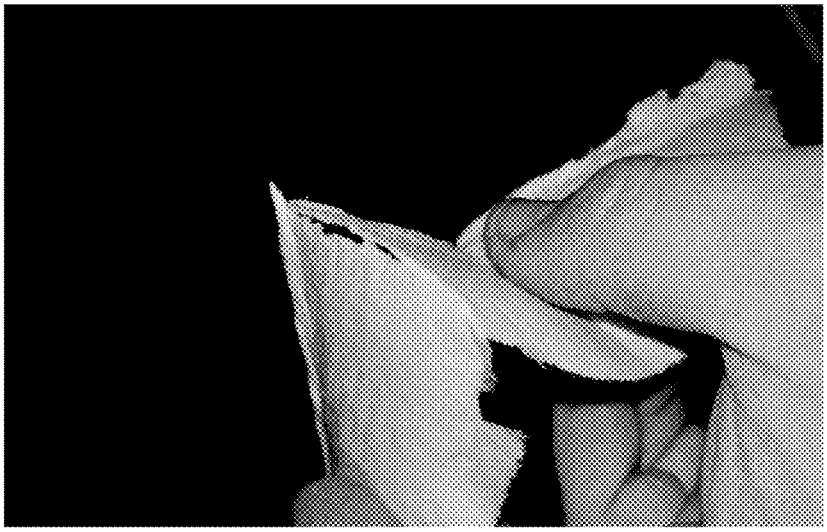

FIGS. 7A and 7B are images depicting the variation of properties of silica fiber mats as a function of ripening time. The mat of FIG. 7A is illustrative of mats electrospun for at least 2-3 days in accordance with embodiments of the invention, while the mat of FIG. 7B is illustrative of mats electrospun after less ripening time in accordance with embodiments of the invention. The material in FIG. 7A has a soft texture and is very flexible; such material may still be processed into fiber dust or used in sheet form. The material in FIG. 7B is brittle, inflexible, and thin, and may be easily processed into fiber dust.

Figure 8A:
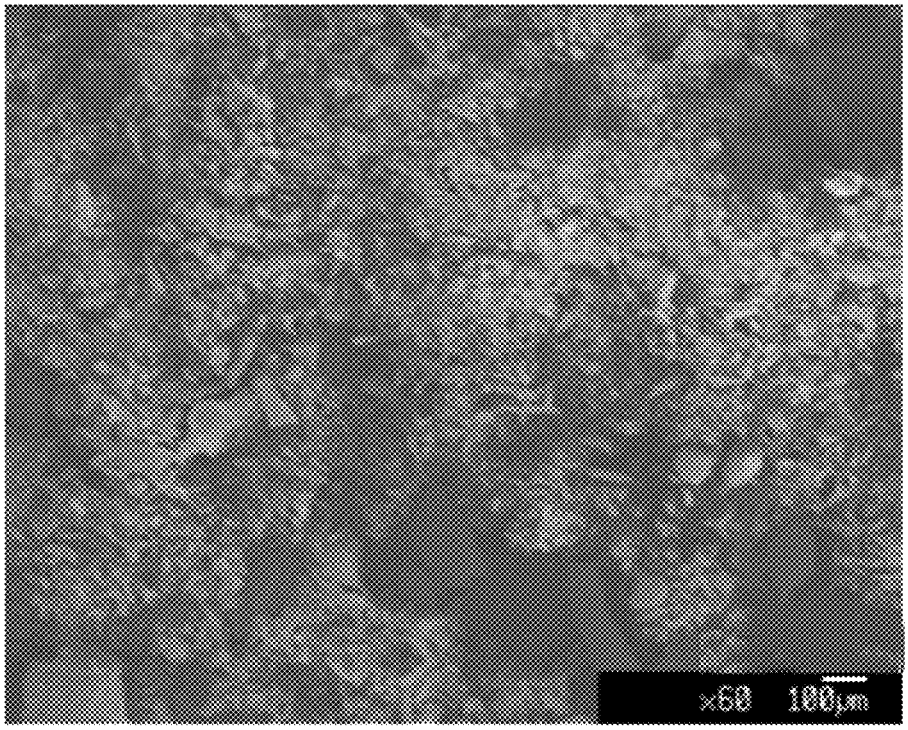
FIGS. 8A and 8B show SEM images of fiber dust in accordance with embodiments of the invention, with 100 μm scale shown.
Figure 8B:
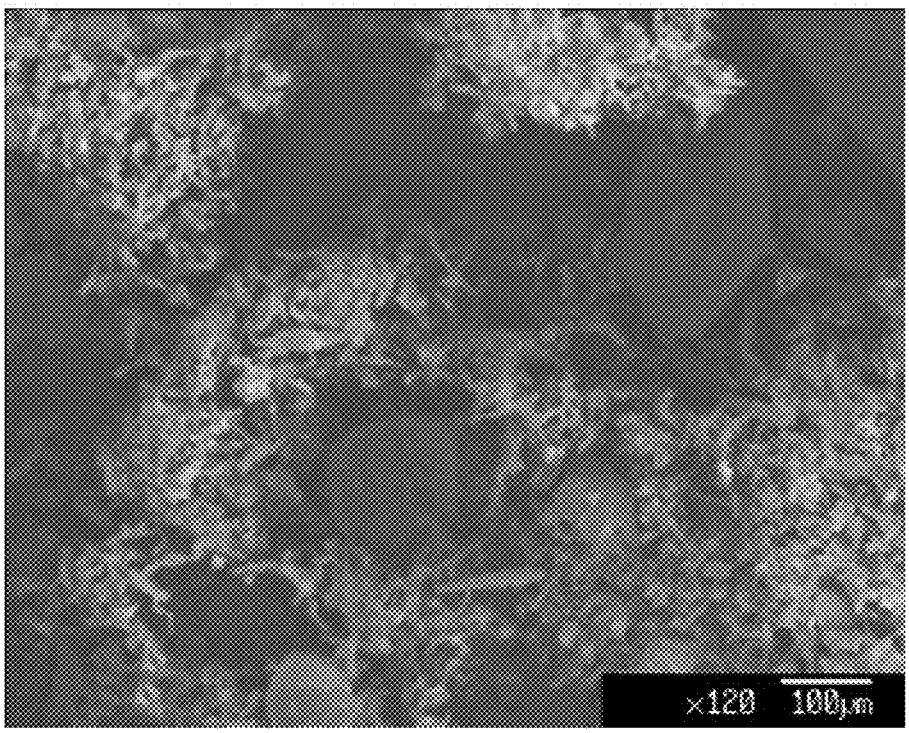

A silica fiber mat was fabricated and broken into fragments by rubbing through a series of screens of decreasing mesh size. The final screen was a 200 mesh screen, resulting in fiber dust and/or fibrous fragments having sizes of approximately 20 μm to approximately 200 μm. FIGS. 8A and 8B show SEM images of the resulting fiber dust, with 100 μm scale shown.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

The invention claimed is:

1. An electrospinning apparatus comprising:

an electrically insulating manifold having one or more inlets and defining a plurality of outlet holes;

for supplying a precursor solution to the manifold, one or more electrically insulating tubes each having a first end coupled to one of the inlets;

a conductive plate spaced apart from the manifold and positioned to receive precursor solution from the plurality of outlet holes;

a high-voltage source electrically coupled to the conductive plate; and spaced apart from a front edge of the conductive plate, an electrically grounded collector, wherein the collector is positioned to receive electrospun precursor solution, in fibrous form, from the front edge of the conductive plate.

2. The apparatus of claim 1, further comprising, fluidly couplable to a second end of at least one of the tubes, a holding tank for containing the precursor solution.

3. The apparatus of claim 2, further comprising a pump for controlling flow of the precursor solution from the holding tank into the manifold.

4. The apparatus of claim 3, wherein the pump is a peristaltic pump.

5. The apparatus of claim 1, wherein at least the front edge of the conductive plate defines therein a plurality of recesses.

6. The apparatus of claim 1, wherein the conductive plate is angled downward with the front edge of the conductive plate disposed below a back edge of the conductive plate.

7. The apparatus of claim 1, wherein the collector comprises a planar surface.

8. The apparatus of claim 1, wherein the collector comprises a rotatable drum.

9. The apparatus of claim 8, further comprising a blower positioned to blow air or another gas toward the collector.

10. The apparatus of claim 1, further comprising a blower or sprayer configured to dispense one or more fluids toward the collector and/or toward an area between the conductive plate and the collector.

11. The apparatus of claim 1, wherein the manifold and/or the collector is translatable in a direction substantially perpendicular to a spinning direction extending from the conductive plate to the collector.

12. The apparatus of claim 1, wherein the high-voltage source is configured to supply a voltage ranging from approximately 5 kV to approximately 50 kV.

13. A method of electrospinning fibers, the method comprising:

supplying a precursor solution into an electrically insulating manifold defining a plurality of outlet holes disposed above and spaced apart from a conductive plate;

applying a voltage to the conductive plate;

allowing the precursor solution to exit the outlet holes onto the conductive plate, whereby fibers are formed from the precursor solution proximate a front edge of the conductive plate and deposited on a collector spaced apart from the conductive plate.

14. The method of claim 13, wherein supplying the precursor solution comprises pumping the precursor solution from a holding tank to the manifold through one or more tubes.

15. The method of claim 14, wherein the precursor solution is pumped via a peristaltic pump.

16. The method of claim 13, further comprising rotating the collector during formation of the fibers.

17. The method of claim 13, further comprising blowing air or another gas toward the collector during formation of the fibers.

18. The method of claim 13, further comprising removing material from the conductive plate during and/or after fiber formation.

19. The method of claim 13, further comprising disposing one or more additives into the precursor solution before allowing the precursor solution to exit onto the conductive plate, whereby the one or more additives are incorporated into the fibers.

20. The method of claim 13, further comprising dispensing one or more additives onto the fibers after formation of the fibers and before the fibers are deposited on the collector, whereby the one or more additives are incorporated into the fibers.

21. The method of claim 13, further comprising dispensing one or more additives onto the fibers after the fibers are deposited on the collector, whereby the one or more additives are incorporated into the fibers.

22. The method of claim 13, further comprising, after the fibers are deposited on the collector, processing at least a portion of the fibers into a powder or dust.

23. The method of claim 13, wherein (i) the precursor solution is a sol-gel, and (ii) the fibers comprise silica.

24. The method of claim 23, wherein the sol-gel is prepared with tetraethylorthosilicate (TEOS).

25. The method of claim 24, wherein the sol-gel contains 70% to 90% TEOS by weight, 8% to 25% ethanol by weight, an acid catalyst, and the balance water.

26. The method of claim 25, wherein the sol-gel is allowed to transition for at least 2 days under conditions where humidity is within the range of about 40% to about 80%, and the temperature is within the range of about 50° F. to about 90° F.

* * * * *